US007938573B2

(12) United States Patent
Gau et al.

(10) Patent No.: US 7,938,573 B2
(45) Date of Patent: May 10, 2011

(54) CARTRIDGE HAVING VARIABLE VOLUME RESERVOIRS

(75) Inventors: Jen-Jr Gau, Long Beach, CA (US); Arvin Trung Chang, West Covina, CA (US)

(73) Assignee: GENEFLUIDICS, Inc., Monterey Park, CA (US)

( * ) Notice: Subject to any disclaimer, the term of this patent is extended or adjusted under 35 U.S.C. 154(b) by 1152 days.

(21) Appl. No.: 11/219,516

(22) Filed: Sep. 2, 2005

(65) Prior Publication Data

US 2007/0053796 A1 Mar. 8, 2007

(51) Int. Cl.
*B01F 5/10* (2006.01)

(52) U.S. Cl. ..... 366/131; 366/275

(58) Field of Classification Search ..... 366/131, 366/132, 176.1, 275
See application file for complete search history.

(56) References Cited

U.S. PATENT DOCUMENTS

| | | | | | |
|---|---|---|---|---|---|
| 265,442 | A | | 10/1882 | Reesman | |
| 2,152,455 | A | * | 3/1939 | Ballentine | 366/275 |
| 2,376,221 | A | | 4/1942 | Baker | |
| 4,227,548 | A | * | 10/1980 | Botnick | 137/606 |
| 4,236,516 | A | * | 12/1980 | Nilson | 604/214 |
| 5,077,017 | A | * | 12/1991 | Gorin et al. | 422/100 |
| 5,223,219 | A | * | 6/1993 | Subramanian et al. | 422/55 |
| 5,370,626 | A | * | 12/1994 | Farris | 604/187 |
| 5,836,750 | A | * | 11/1998 | Cabuz | 417/322 |
| 5,922,591 | A | * | 7/1999 | Anderson et al. | 435/287.2 |
| 6,062,722 | A | * | 5/2000 | Lake | 366/130 |
| 6,552,784 | B1 | * | 4/2003 | Dietz et al. | 356/246 |
| 6,613,286 | B2 | * | 9/2003 | Braun et al. | 422/102 |
| 7,241,421 | B2 | * | 7/2007 | Webster et al. | 422/100 |
| 7,318,912 | B2 | * | 1/2008 | Pezzuto et al. | 422/103 |
| 2003/0107946 | A1 | | 6/2003 | Cosby et al. | |
| 2005/0196855 | A1 | * | 9/2005 | Gau et al. | 435/287.2 |

* cited by examiner

*Primary Examiner* — David L Sorkin
(74) *Attorney, Agent, or Firm* — Gavrilovich, Dodd & Lindsey, LLP

(57) ABSTRACT

The cartridge can include a mixing component for mixing different solutions so as to form a product solution. A mixture of different solutions can be transported into the mixing component where they combine to form a product solution. The mixing component includes a plurality of variable volume reservoirs in liquid communication with one another. The product solution can be repeatedly transported from one of the variable volume reservoirs to another of the variable volume reservoirs until the desired degree of mixing is achieved. Once the desired degree of mixing is achieved, the product solution can be transported directly to a product chamber within the cartridge or can be treated further before being transported to the product chamber.

24 Claims, 21 Drawing Sheets

CARTRIDGE HAVING VARIABLE VOLUME RESERVOIRS

BACKGROUND

1. Field of the Invention

The invention relates to assays and more particular to a cartridge for use with assays.

2. Background of the Invention

A variety of assays have been developed to detect the presence and/or amount of biological or chemical agents in a sample. The desire for assays that can be performed in the field has increased the demand for smaller and more efficient assay equipment. This demand has been met with equipment that employs one or more sensors held within a cartridge. The cartridge can generally be extracted from or inserted into an assay system at the location where the assay is performed.

During an assay, one or more solutions are delivered to the sensors. The storage and preparation of these solutions is a significant obstacles to the implementation of the technologies. An additional obstacle is the difficulty associated with effectively transporting these solutions to the sensor under the proper conditions. For instance, there is often a need to mix the solutions shortly before they are transported to a sensor. As an example, it is often desirable to mix blood and a lysate buffer before transporting them to a sensor or to mix a probe solution and a lysate before delivering them to a sensor. As a result, there is a need for more efficient and effective assay equipment.

SUMMARY OF THE INVENTION

A cartridge is disclosed. The cartridge is has one or more variable volume reservoirs. For instance, the cartridge can include a transport channel for transporting a fluid from one location in the cartridge to another location in the cartridge. An opening in the channel can permit the fluid to flow into the variable volume reservoir from the channel and/or into the channel from the variable volume reservoir. The variable volume reservoir can be at least partially defined by a flexible layer positioned over the opening. Flexing of the flexible layer permits the volume of the reservoir to change.

The cartridge can include a mixing component for mixing different solutions so as to form a product solution that can be transported to a product chamber. The mixing component can include a plurality of the variable volume reservoirs. A mixing channel can transport the solution between the variable volume reservoirs in the mixing component. Additionally, the cartridge can include one or more inlet channels configured to transport the solutions into the mixing component and one or more outlet channels configured to transports the product solution to the product chamber.

A method of mixing the solutions in the mixing component of the cartridge is also disclosed. The method includes transporting a plurality of solutions into the mixing component so as to form a product solution. The product solution is then transported from one variable volume reservoir into another variable volume reservoir until the desired degree of mixing is achieved. After the desired degree of mixing is achieved, all or a portion of the product solution can be transported to one or more product chambers.

The variable volume reservoirs can also be employed to control the volume of a solution that is transported into a chamber. For instance, the cartridge can include a plurality of variable volume reservoirs that are each in liquid communication with one another and with a plurality of chambers in the cartridge. The cartridge can also include one or more valves arranged such that closing a portion of the valves closes the liquid communication between a first one of the variable volume reservoirs and the other variable volume reservoirs while permitting liquid communication between the first variable volume reservoir and a first one of the chambers.

A method of operating the cartridge so as to control the volume of solution transported into a chamber is also disclosed. The method includes transporting a solution into a first variable volume reservoir in a cartridge. The first variable volume reservoir is in liquid communication with one or more second variable volume reservoirs in the cartridge. The cartridge also includes a first chamber and one or more second chambers that are in liquid communication with the first variable volume reservoir and the one or more second variable volume reservoirs. The method also includes closing one or more valves so as to close the liquid communication between the first variable volume reservoir and the one or more second variable volume reservoirs and between the first variable volume reservoir and the one or more second chambers. Accordingly, the one or more valves are closed so as to hydraulically isolate the first variable volume reservoir from the one or more second variable volume reservoirs and from the one or more second chambers. The method further includes transporting the solution from the first variable volume reservoir to the first chamber.

One or more of the variable volume reservoirs can be employed in conjunction with a vent channel. For instance, the cartridge can include a vent channel that intersects a transport channel such that the vent channel carries gasses from the transport channel. The vent channel can be in fluid communication with a variable volume reservoir. Accordingly, the vent channel can transport the gasses from the transport channel to the variable volume reservoir.

BRIEF DESCRIPTION OF THE FIGURES

FIG. 1A is a perspective view of a storage component and a transport component before assembly of the cartridge.

FIG. 1B is a perspective view of the cartridge after assembly.

FIG. 3A is a perspective view of the storage component. The storage component includes a cover, a base, and a sealing medium.

FIG. 3B is a cross section of the storage component shown in FIG. 3A taken along the line labeled B.

FIG. 3C is a perspective view of the storage component before assembly of the storage component.

FIG. 4A is a cross section of the storage component shown in FIG. 3A taken along the line labeled B.

FIG. 4B is a bottom-view of the storage component shown in FIG. 4A without the sealing medium in place.

FIG. 4C is a perspective view of a portion of the transport component.

FIG. 4D is a cross section of a cartridge employing the disruption mechanism illustrated on the transport component of FIG. 4C.

FIG. 5A through FIG. 5F illustrate a suitable construction for a transport component configured to operate as disclosed with respect to FIG. 2. FIG. 5A is a perspective view of the parts of a transport component before assembly of the transport component.

FIG. 5B is a different perspective view of the parts of a transport component before assembly of the transport component. The view of FIG. 5B is inverted relative to the view of FIG. 5A.

FIG. 5C is a cross section of the cover shown in FIG. 5B taken along the line labeled C.

FIG. 5D is a cross section of a portion of the transport component having a vent channel.

FIG. 5E is bottom view of the portion of a cover having a vent channel with a constriction region.

FIG. 5F is a cross section of the constriction region taken at the line labeled F.

FIG. 6A is a topview of the portion of the transport component that includes the valve.

FIG. 6B is a bottom view of the portion of the transport component shown in FIG. 6A.

FIG. 6C is a cross section of the cartridge shown in FIG. 6A taken along a line extending between the brackets labeled C. The cross section shows the valve before the flow of a solution through the valve.

FIG. 6D is a cross section of the cartridge shown in FIG. 6A taken along a line extending between the brackets labeled D. The valve is shown before the flow of a solution through the valve.

FIG. 6E illustrates the valve of FIG. 6C and FIG. 6D during the flow of a solution through the valve.

FIG. 7A is a perspective view of the portion of the cover that includes the valve.

FIG. 7B illustrates a cross section of a transport component that includes the cover shown in FIG. 7A taken along a line extending between the brackets labeled B. The cross section illustrates a valve before the flow of a solution through the valve.

FIG. 7C illustrates a cross section of a transport component that includes the cover shown in FIG. 7A taken along a line extending between the brackets labeled C. The cross section illustrates a valve before the flow of a solution through the valve.

FIG. 7D illustrates the valve during the flow of a solution through the valve.

FIG. 8A is a sideview of a system including the cartridge positioned on a manifold.

FIG. 8B is a cross section of the system shown in FIG. 8A.

FIG. 9A is a top-view of the portion of the transport component that includes the mixing component. The mixing component includes a plurality of variable volume reservoirs.

FIG. 9B is a bottom view of the portion of the transport component shown in FIG. 9A.

FIG. 9C is a cross section of the cartridge shown in FIG. 9B taken along a line extending between the brackets labeled C.

FIG. 9D is a cross section of the cartridge shown in FIG. 9B taken along a line extending between the brackets labeled D. Each of the variable volume reservoirs is closed.

FIG. 10A is a top-view of the portion of the transport component that includes the volume control device. The volume control device includes a variable volume reservoir.

FIG. 10B is a bottom view of the portion of the transport component shown in FIG. 10A.

FIG. 10C is a cross section of the cartridge shown in FIG. 10B taken along a line extending between the brackets labeled C. The variable volume reservoir is closed.

FIG. 10D illustrates the volume control device of FIG. 10C where the variable volume reservoir contains a solution.

DETAILED DESCRIPTION OF THE PREFERRED EMBODIMENT

A cartridge is disclosed for transporting solutions from storage reservoirs to one or more chambers in the cartridge. The cartridge includes one or more variable volumes reservoirs. The volume of the variable volume reservoirs can change.

The cartridge can include a mixing component for mixing different solutions so as to form a product solution. Different solutions can be transported into the mixing component where they combine to form a product solution. The mixing component includes a plurality of the variable volume reservoirs in liquid communication with one another. The product solution can be transported from one of the variable volume reservoirs to another of the variable volume reservoirs until the desired degree of mixing is achieved. Once the desired degree of mixing is achieved, the product solution can be transported directly to a chamber within the cartridge or can be treated further before being transported to the chamber. In some instances, the chamber includes a sensor such as an electrochemical sensor for detecting the presence and/or amount of an agent in a sample. As a result, the cartridge can permit different solutions to be mixed before being transported to a sensor.

The cartridge can include a plurality of volume control device. The volume control device can include a variable volume reservoir in liquid communication with a chamber. A solution can be transported from a storage reservoir into the variable volume reservoir. The volume of the variable volume reservoir can then be changed such that a desired volume of the solution flows from the variable volume reservoir into the chamber. In some instances, the chamber includes a sensor such as an electrochemical sensor for detecting the presence and/or amount of an agent in a sample. Accordingly, the cartridge provides the ability to control the volume of solution transported to a sensor.

The cartridge can also include one or more vent channels where a fluid is vented from a transport channel through which a solution is transported. The vent channel can be in liquid communication with a variable volume reservoir. The variable volume reservoir can expand as the pressure in the vent channel increases as a result of additional fluids entering the vent channel. Accordingly, the fluids are vented into the variable volume reservoir. As a result, the cartridge allows for internal storage of the gasses and other fluids vented from the channels where the solutions are transported.

Figure 1B:
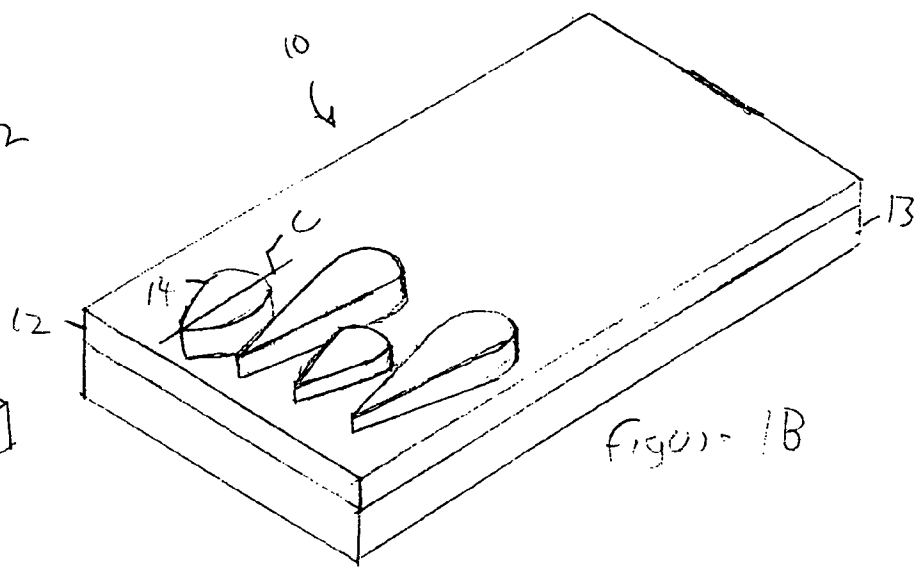
FIG. 1A through FIG. 1B illustrate a cartridge. The cartridge includes a storage component configured to be coupled with a transport component.
Figure 1A:
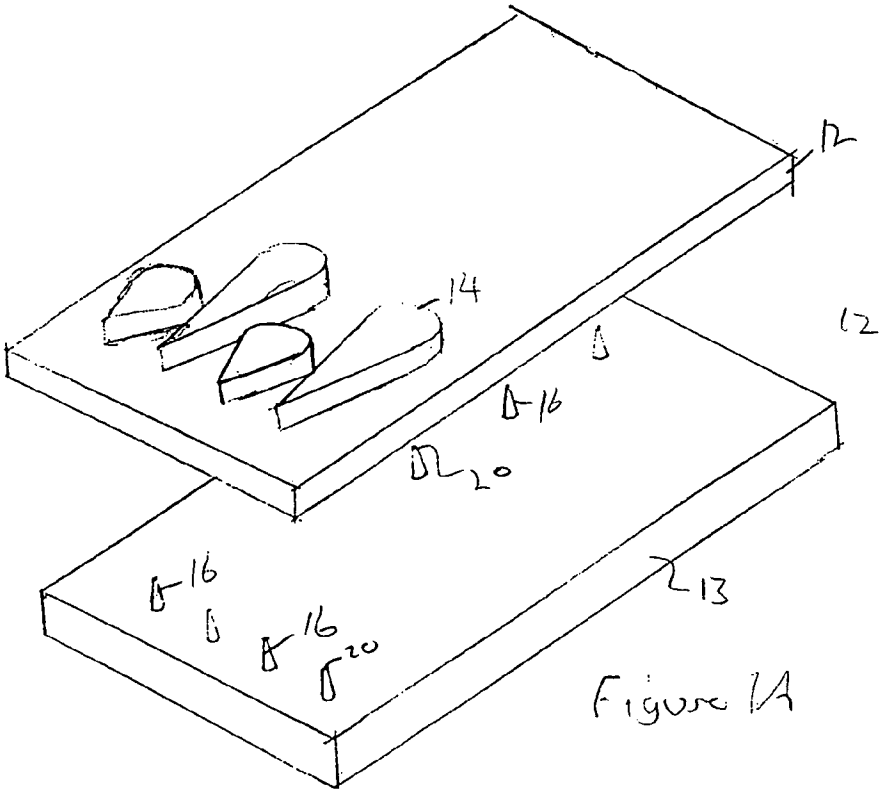

FIG. 1A through FIG. 1B illustrate a cartridge 10. The cartridge 10 includes a storage component 12 configured to be coupled with a transport component 13. FIG. 1A is a perspective view of a storage component 12 and a transport component 13 before assembly of the cartridge 10. FIG. 1B is a perspective view of the cartridge 10 after assembly.

The storage component 12 and the transport component 13 can be coupled together so as to form a substantially planar interface. For instance, coupling the storage component 12 and the transport component 13 can place an upper side of the transport component into contact with a lower side of the storage component as evident in FIG. 1B.

The storage component 12 includes one or more reservoirs 14 configured to store solutions that are use in conjunction with an assay. The storage component can include a medium positioned so as to retain a solution in one or more of the reservoirs. In some instances, the medium is positioned so as to seal one or more of the reservoirs.

The transport component 13 is configured to transport the solutions stored in the reservoirs 14 of a storage component 12 to one or more chambers (not shown) in the transport component 13. The transport component 13 can include one or more disruption mechanisms 16 configured to disrupt the integrity of a medium on the storage component 12 so as to provide an outlet through which a solution in a reservoir 14 on the storage component can flow out of the reservoir 14 and into the transport component 13. The disruption mechanisms 16 can be configured to disrupt the integrity of the medium upon coupling of the storage component 12 to the transport component 13. In some instances, one or more of the disruption mechanisms 16 extend from a side of the transport component 13 as evident in FIG. 1A. As will become evident below, the transport mechanism 13 can also include a lumen (not shown) positioned to receive the solution flowing through the disruption provide by a disruption mechanism 16. The lumen can transport the solution into the transport mechanism 13. In some instances, the lumen is included in the disruption mechanism 16.

Figure 2:
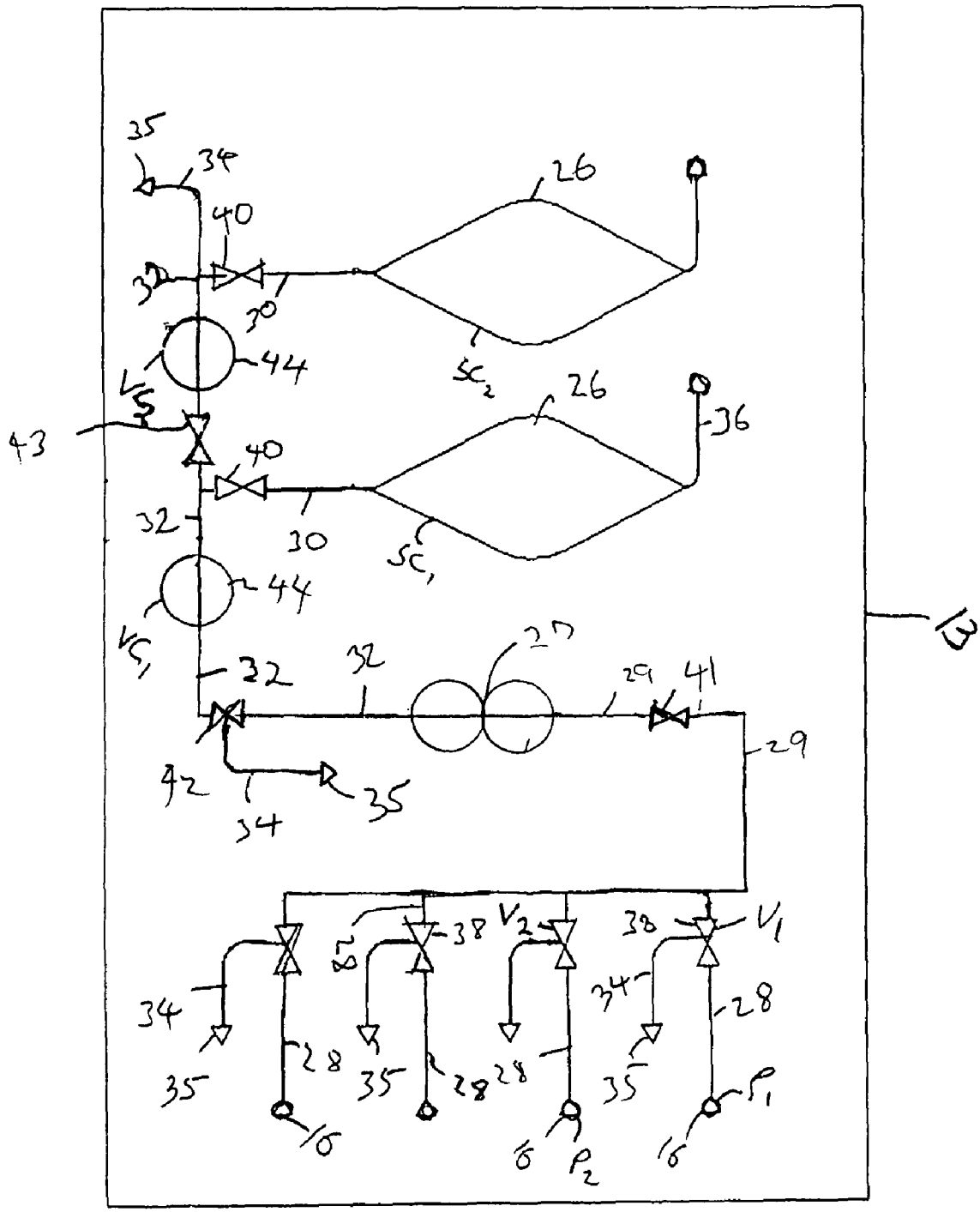
FIG. 2 is a schematic of the interior of a transport component.

FIG. 2 is a schematic diagram illustrating the interior of the transport component 13. The transport component 13 includes one or more product chambers 26. The product chamber 26 can be empty and serve as a storage chamber. Additionally or alternately, the product chamber can include components for processing of the product. For instance, the product chamber can include a porous material for filtration, a catalyst, a reactant for reacting with product, a culture medium or media for culturing, reagents for amplification and/or a coating for anchoring chemical or biological agents in the chamber. In some instances, one or more of the product chambers includes one or more sensors (not shown). A suitable sensor includes, but is not limited to, an electrochemical sensor. Examples of an electrochemical sensor are taught in U.S. patent application Ser. No. 09/848,727, filed on May 5, 2001, entitled "Biological Identification System with Integrated Sensor Chip" and incorporated herein in its entirety. A product chamber can hold other sensors in addition to the electrochemical sensors or as an alternative to the electrochemical sensors. For instance, the cartridge can include optical sensors, temperature sensors, pH sensors, etc. These sensors can be positioned in the sensing chamber or elsewhere in or outside the cartridge.

The transport component 13 includes a mixing component 27 for mixing different solutions before transporting the solutions to a product chamber. As will become evident below, the mixing component can include a plurality of variable volume reservoirs in liquid communication with one another.

The transport component 13 includes a plurality of transport channels through which the solutions flow. For instance, the cartridge includes a plurality of inlet channels for transporting a solution to the mixing component 27. The mixing component 27 can be used to mix different solutions so as to form a product solution that is transported to one or more of the product chambers. Examples of the inlet channels include input channels 28 configured to transport fluid from a disruption mechanism 16, and a first common channel 29 configured to transport solution from an input channel 28 to the mixing component 27. The transport component also includes outlet channels that transport the solution from the mixing component to the product chambers. Examples of outlet channels include a plurality of independent channels 30 configured to transport a solution to a product chamber and a second common channel 32 configured to transport solutions from the mixing component 27 to the independent channels 30.

The transport component 13 includes a plurality of vent channels 34. The vent channels interface with one of the transport channels such that the vent channel transports gasses from the transport channel. For instance, the vent channels illustrated in FIG. 2 interface with the input channels such that air is vented from the input channel. In particular, the vent channels interface with the input channels at a valve. The vent channels 34 are configured to vent air from the valve while allowing solution to flow through the valve. For instance, a vent channel can be configured to vent air from an input channel while a solution is transported along the input channel and into the valve. The vent channels are in fluid communication with a vent relief device 35 where the gasses carried by the vent channel are stored and/or released to the atmosphere.

The transport component 13 includes a waste channel 36 extending from each product chamber. The waste channel 36 is configured to carry solution away from the product chamber.

The transport component 13 includes a plurality of valves configured to control the flow of the solutions through the transport component 13. First valves 38 are each positioned between the first common channel 29 and a disruption mechanism 16. Although the first valves 38 are each shown positioned part way along the length of an input channel 28, one or more of the first valves can be positioned at the intersection of an input channel 28 and the first common channel 29. Second valves 40 are positioned between each of the independent channels 30 and a disruption mechanism 16. Although the second valves 40 are each shown positioned part way along the length of the independent channels 30, one or more of the second valves can be positioned at the intersection of an independent channel 30 and the second common channel 32.

An inlet valve 41 is positioned along the first common channel 29 and an outlet valve 42 is positioned along the second common channel 32. The transport component optionally includes one or more volume control devices 44 positioned along the second common channel 32. A volume control device 44 can be employed to control the volume of a liquid that is transported to a product chamber. As will become evident below, a volume control device 44 can include variable volume reservoir.

The illustrated transport component includes a plurality of volume control devices that are in liquid communication with one another and with the product chambers. For instance, a portion of the second common channel 32 provides liquid communication between the volume control devices. An isolation valve 43 is positioned along the second common channel 32 between the volume control channels and between the independent channels 30. As a result, closing the isolation valve 43 permits liquid communication between a volume control device and one of the product chambers while closing the liquid communication between the volume control device and the other product chambers.

In some instances, solutions are transported from the reservoirs 14 (FIG. 1A) into the mixing component. The solutions are mixed in the mixing chamber to provide a product solution. The product solution is then transported into each of the product chambers 26 in a desired volume. For instance, the first valve 38 labeled $V_1$, the inlet valve 41, and the associated vent relief device 35 can be opened to vent air during solution delivery, and the outlet valve 42 closed after venting, and the pressure on a solution contained within a reservoir (FIG. 1A) disrupted by the disruption mechanism 16 labeled $P_1$ can be increased. The solution flows through a first portion of the input channel 28, through the first valve 38 labeled $V_1$, into a second portion of the input channel, into the first common channel 29 and into the mixing component 27. The first valve 38 labeled $V_1$ is closed, the first valve 38 labeled $V_2$ is opened, and the pressure on a second solution contained within a reservoir (FIG. 1A) disrupted by the disruption mechanism 16 labeled $P_2$ can be increased. The second solution flows through a first portion of the input channel 28, through the first valve 38 labeled $V_2$, into a second portion of the input channel, into the first common channel 29 and into the mixing component 27. When the transport component includes an inlet valve 41, the inlet valve and/or each of the first valves 38 can be closed and the mixing component operated as to mix the solutions so as to form a product solution. When the transport component does not include an inlet valve 41, each of the first valves 38 can be closed and the mixing component operated as to mix the solutions so as to form a product solution.

When the transport component does not include volume control devices, the outlet valve 42 can be opened and the product solution transported from the mixing component into contact with the second valves 40. The second valves 40 associated with the product chambers that are to receive the solution are opened and the solution flows through the associated independent channels 30 and into the product chambers 26. When the transport component includes volume control devices and delivery of a particular solution volume into a product chamber is desired, the second valves 40 are closed, the outlet valve 42 is opened, the isolation valve 43 is opened and the product solution transported from the mixing component 37 into the volume control devices. The outlet valve 42 and the isolation valve 43 are then closed so as to permit transport of the solution from each of the volume control devices into a product chamber while hydraulically isolating the volume control devices from the other product chambers. For instance, the volume control device labeled $VC_1$ is in liquid communication with the product chamber labeled $SC_1$ but is isolated from the product chamber labeled $SC_2$. Each volume control device is then operated so a desired volume of the solution in the volume control device is transported into the product chamber.

Figure 3B:
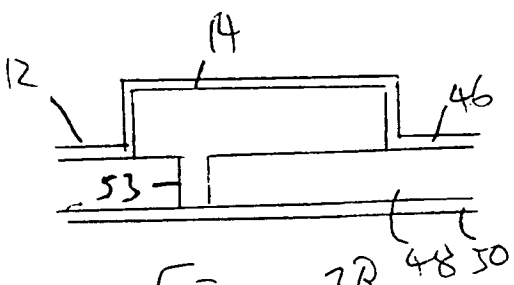
FIG. 3A through FIG. 3C illustrate a suitable construction for a storage component.
Figure 3A:
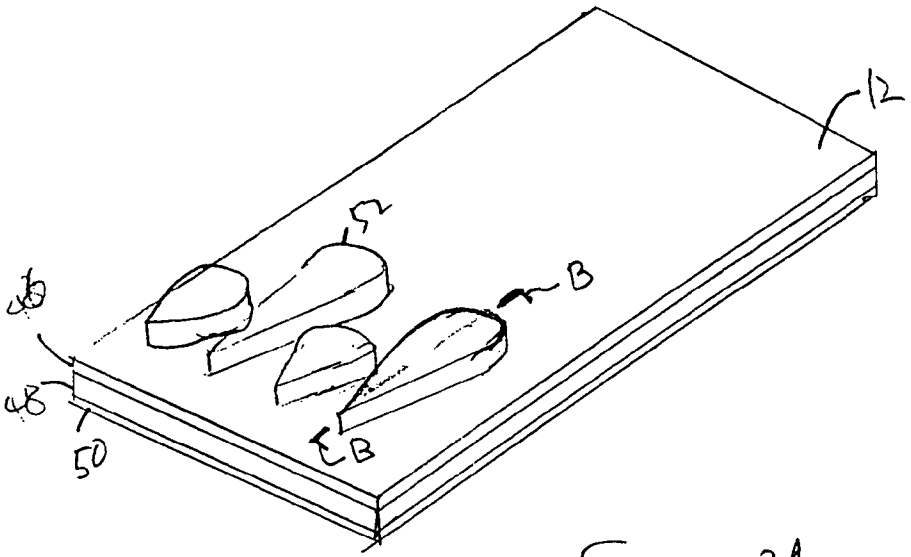
Figure 3C:
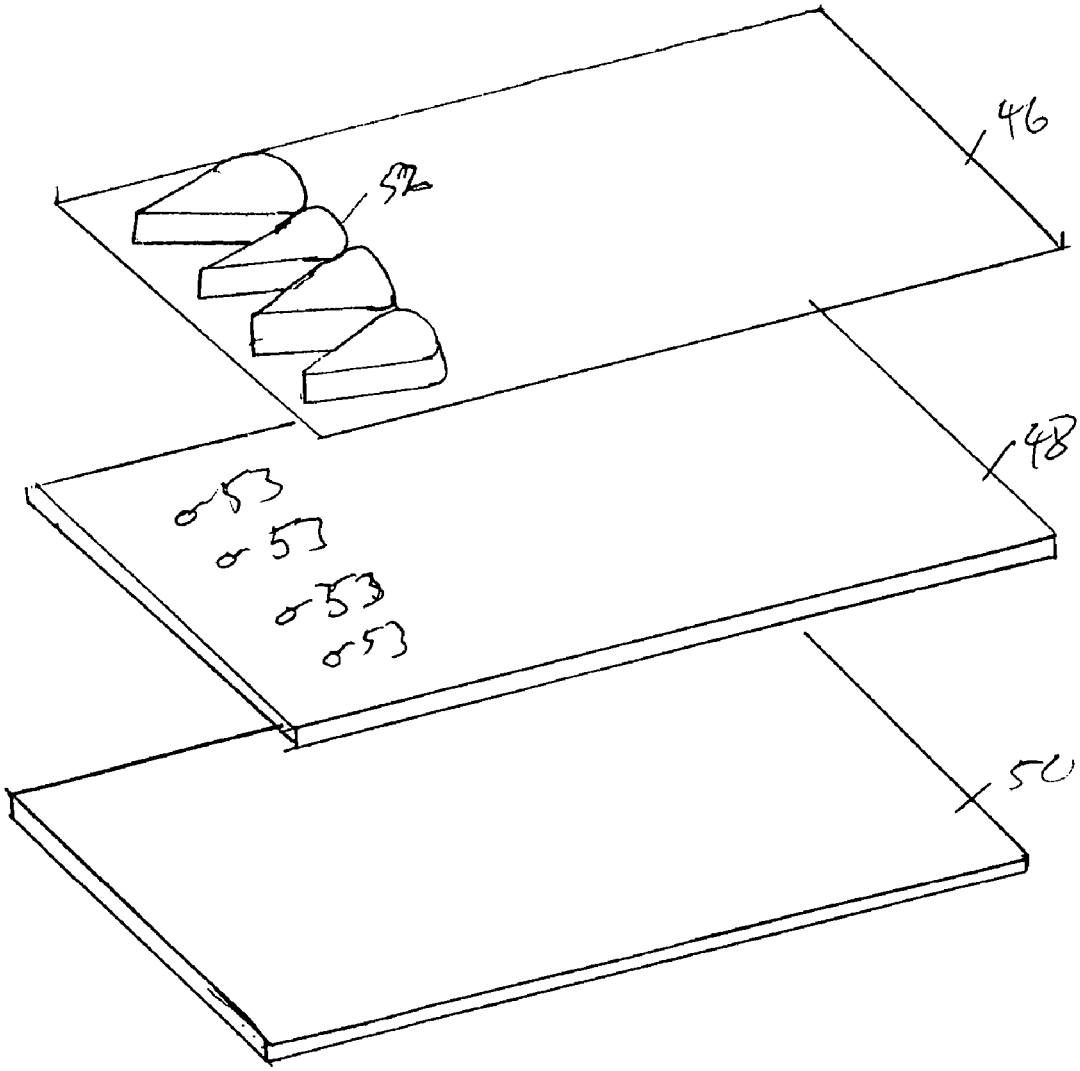

FIG. 3A through FIG. 3C illustrate a suitable construction for a storage component 12. FIG. 3A is a perspective view of the storage component 12. FIG. 3B is a cross section of the storage component 12 shown in FIG. 3A taken along a line extending between the brackets labeled B in FIG. 3A. FIG. 3C is a perspective view of the storage component 12 before assembly of the cartridge. The storage component 12 includes a cover 46, a base 48 and a sealing medium 50. The cover 46 includes a plurality of pockets 52 extending from a common platform 54. The cover 46 is coupled with the base 48 such that the pockets 52 each define a portion of a reservoir 14 and the base 48 defines another portion of the reservoir 14. A plurality of openings 53 each extend through the base 48 and are positioned so as to provide an opening into a reservoir 14.

The sealing medium 50 extends across the holes so as to seal solutions in the reservoirs. The sealing medium 50 can include one or more layers of material. A preferred sealing medium 50 includes a primary layer that seals the openings 53 in the base 48 and can re-seal after being pierced. For instance, the sealing layer 50 can include a septum. The use of a septum can simplify the process of filling the reservoirs 14 with solution. For instance, a needle having two lumens can be inserted into a reservoir 14 through the septum and through one of the openings 53 in the base 48. The air in the reservoir 14 can be extracted from the reservoir 14 through one of the lumens and a solution can be dispensed into the reservoir 14 through the other lumen. The septum reseals after the needle is withdrawn from the reservoir 14.

A suitable material for the cover 46 includes, but is not limited to, a thermoformed film such as a thermoformed PVC film, polyethylene, polyurethane or other elastomer. The base 48 can be constructed of a rigid material. The rigid material can preserve the shape of the solution storage component. A suitable material for the base 48 includes, but is not limited to, PVC, polyethylene, polyurethane or other elastomer. A suitable material for the primary layer of the sealing medium includes, but is not limited to, septa materials such as Silicone 40D, polyethelene or other elastomer. Suitable techniques for bonding the cover to the base 48 include, but are not limited to, RF sealing, heat bonding or adhesive. Suitable techniques for bonding the sealing medium 50 to the base 48 include, but are not limited to, heat bonding, laser welding, epoxies or adhesive(s).

Figure 3D:
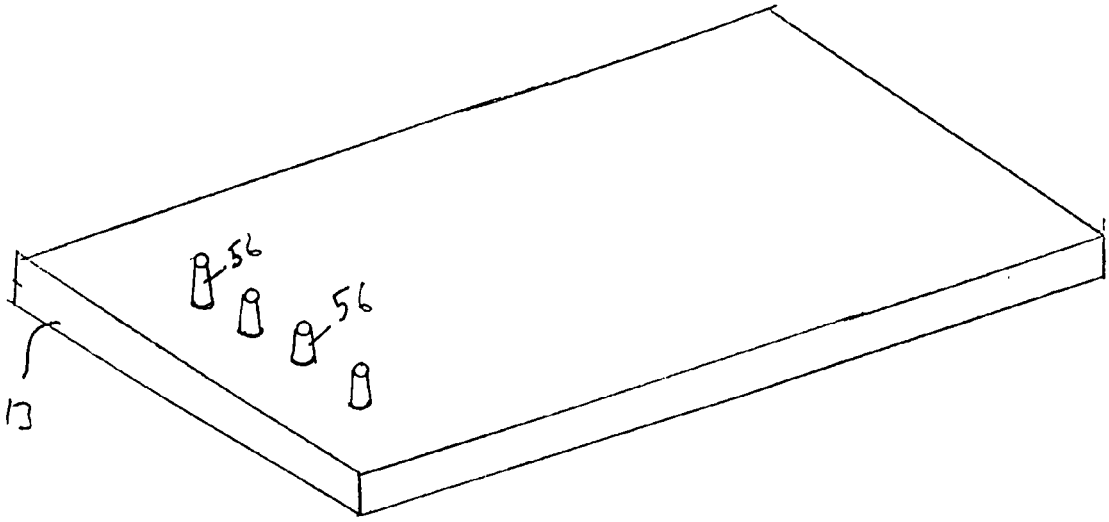
FIG. 3D is a perspective view of a transport component having disruption mechanisms suitable for use with a storage component according to FIG. 3A through FIG. 3C.
Figure 3E:
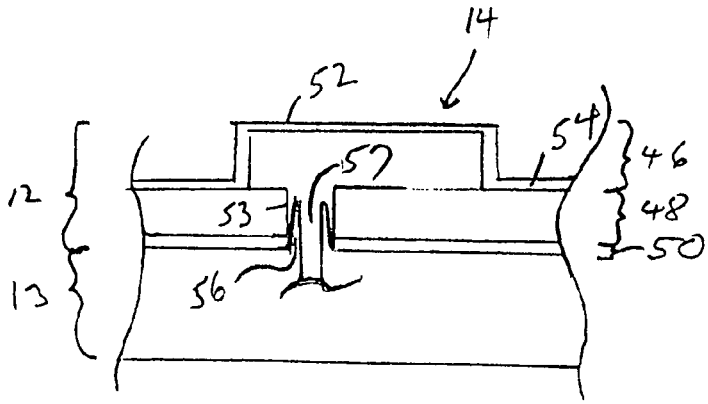
FIG. 3E is a cross section of a cartridge employing the storage component of FIG. 3A and the transport component of FIG. 3D. The cross section is taken through a disruption mechanism.

FIG. 3D through FIG. 3E illustrates a transport component suitable for use with the storage component illustrated in FIG. 3A through FIG. 3C. FIG. 3D is a perspective view of a portion of the transport component. A plurality of piercing mechanisms 56 extend from a side of the transport component. The piercing mechanisms 56 serve as disruption mechanisms that can disrupt the sealing integrity of the sealing medium. FIG. 3E is a cross section of a cartridge employing the storage component of FIG. 3A and the transport component of FIG. 3D. The cross section is taken through piercing mechanism 56.

The piercing mechanisms 56 are positioned on the transport component so as to be aligned with the pockets in the storage component. Upon coupling of the storage component 12 and the transport component 13, the piercing mechanisms 56 pierce the portion of the sealing medium 50 that seals the reservoirs. Piercing of the sealing medium 50 allows the solution in a reservoir to flow into contact with a piercing mechanism 56. A lumen 57 extends through one or more of the piercing mechanisms 16 and into the transport component 13. Accordingly, the lumen 57 can transport a solution from a reservoir into the transport component 13.

As evident in FIG. 3E, the piercing mechanisms 56 are positioned on the transport component 13 so as to be aligned with the openings 53 in the base 48 of the storage component 12. The base 48 can be constructed of a material that cannot be pierced by a piercing mechanism 56. Accordingly, the piercing mechanisms pierce the portion of the sealing medium extending across the openings. As a result, the base 48 limits the location of disruptions created by a piercing mechanism 56 to a localized region of the sealing medium 50.

Figure 4A:
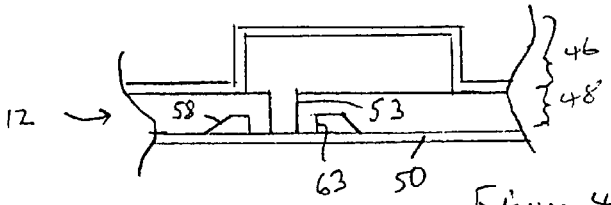
FIG. 4A through FIG. 4D illustrate a cartridge employing a different embodiment of a disruption mechanism.
Figure 4B:
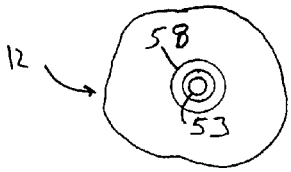
Figure 4C:
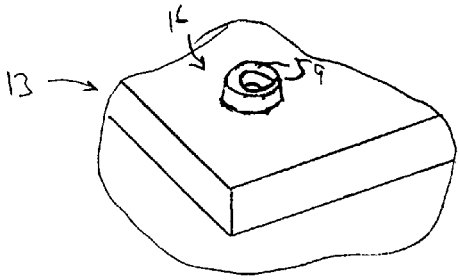
Figure 4D:
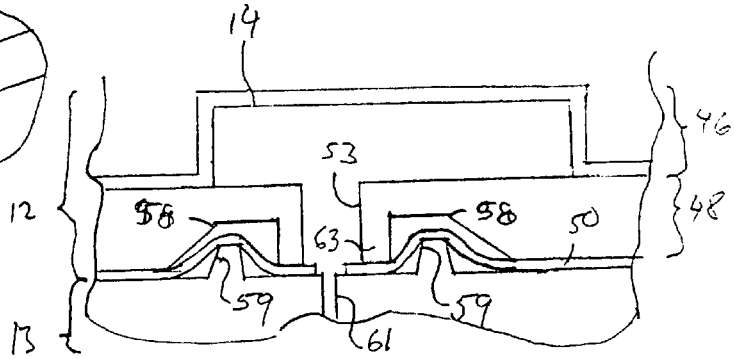
Figure 54:
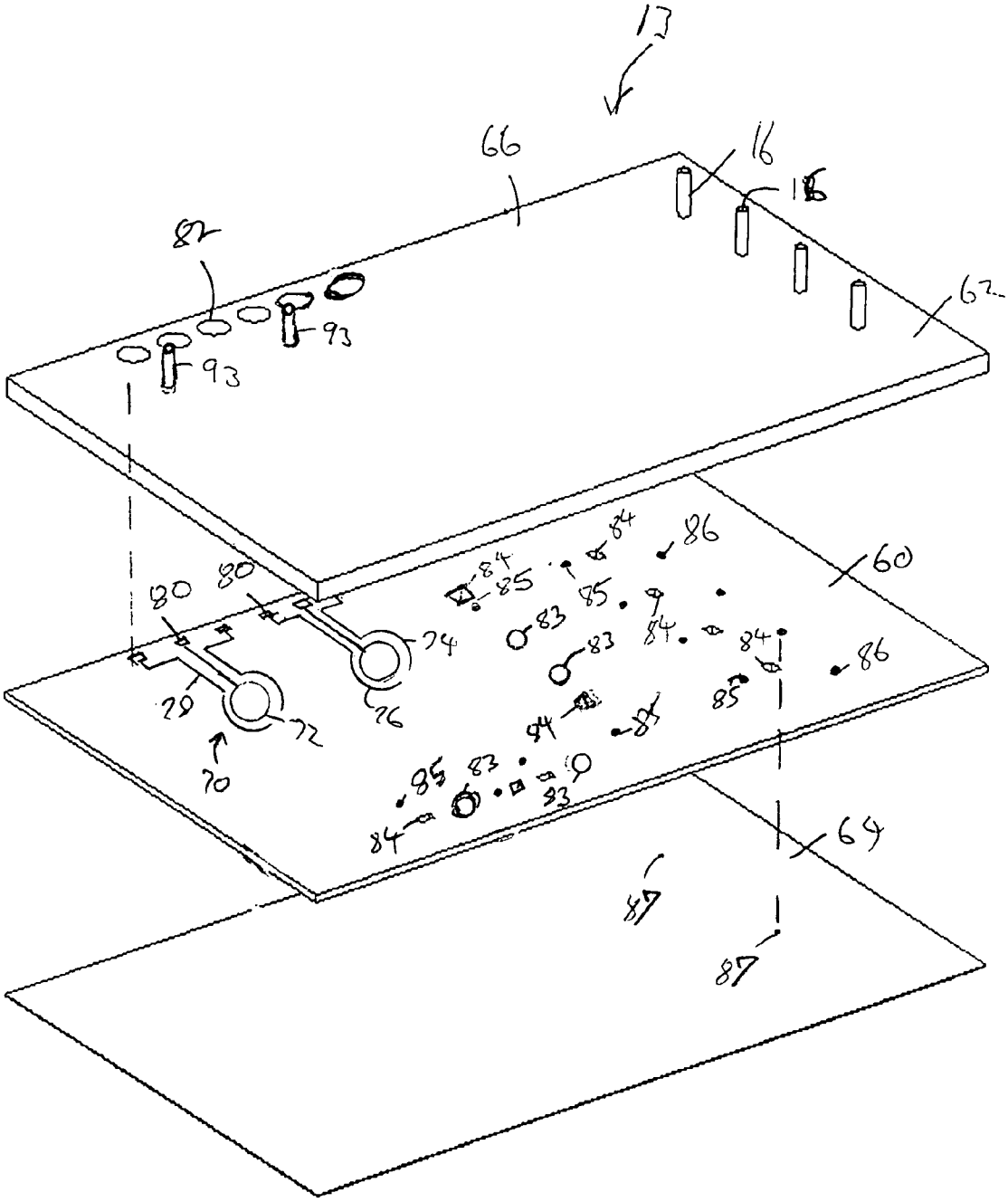

FIG. 4A through FIG. 4D illustrate a cartridge employing a different embodiment of a disruption mechanism 16. FIG. 4A is a cross section of a storage component 12 taken along the line labeled B in FIG. 3A. The storage component 12 includes a cover 46, a base 48 and a sealing medium 50. FIG. 4B is a bottom-view of the storage component 12 shown in FIG. 4A without the sealing medium 50 in place. FIG. 4C is a perspective view of a portion of the transport component having the disruption mechanism. FIG. 4D is a cross section of a cartridge employing the disruption mechanism 16 illustrated on the transport component 13 of FIG. 4C.

An opening 53 extends through the base 48 of the storage component 12 so as to provide fluid pathway from a reservoir 14. The base 48 includes a recess 58 extending into the bottom of the base 48 and surrounding the opening 53. Before coupling the transport component with the storage component, the sealing medium 50 extends across the recess 58 and the opening 53 and accordingly seals the opening 53 as evident in FIG. 4A.

A ridge 59 extending from a side of the transport component shown in FIG. 4C defines a cup on the side of the transport component 13. The cup serves as a disrupting mechanism 16. Upon coupling of the storage component 12 and the transport component 13, the cup pushes a portion of the sealing medium 50 into the recess 58 as shown in FIG. 4D. The pushing motion stretches the sealing medium 50. The sealing medium 50 can include one or more channels that open upon stretching but that are closed without stretching. The one or more channels are positioned over the opening 53 and/or over the recess 58. As a result, the solution in a reservoir 14 can flow from the reservoir 14 through the one or more channels into contact with the disruption mechanism 16. Accordingly, the one or more channels opened by a cup each serve as a disruption in the sealing integrity of the sealing medium. An opening 61 extends from the bottom of the cup into the transport component 13. As a result, the solution can flow from the reservoir 13, through the one or more disruptions in the sealing medium 50 and into the transport component 13.

Suitable sealing media for use with the cups includes, but is not limited to, thermoplastic elastomers (TPEs).

Although the recess 58 is illustrated as surrounding the opening 53 and spaced apart from the opening such that a lip 63 is formed around the opening 53, the recess 58 need not be spaced apart from the opening. For instance, the recess 58 can transition directly into the opening 53 such that the lip 63 is not present. When the lip 63 is not present, the disruption mechanism can be structured as a cup, as a blunted piercing mechanism or as a combination of the two.

Although the recess is disclosed as surrounding the opening, the recess 58 can be positioned adjacent to the opening 53 without surrounding the opening 53 and the associated disruption mechanism 16 can include ridges configured to be received by the recess 58. Although FIG. 4C illustrates a transport component 13 having a single disruption mechanism 16 that includes a cup, more than one or all of the disruption mechanisms on the transport component can include a cup. Further, a transport component can include a combination of piercing mechanisms and cups that serve as disruption mechanisms.

When pockets serve as the reservoirs in the storage component, the pockets can be deformable when an external pressure is applied. During operation of the cartridge 10, an operator can apply pressure to a pocket to drive a solution from within the reservoir and into the transport component 13. Accordingly, pressure applied to the pockets can be employed to transport solution from a reservoir into the transport component. A material for the cover 46 of the storage component 12 such as PVC or polyurethane allows a pocket 52 to be deformed by application of a pressure to the pocket 52.

Although each of the storage components illustrated above having a single sealing medium extending across each of the openings 53, the storage component can include more than one sealing medium and each of the sealing media can extend across one or more of the openings.

Although not illustrated, the sealing media 50 disclosed above can include a secondary sealing layer positioned over the primary layer. The secondary sealing layer can be applied to the storage component after solutions are loaded into the reservoir(s) 14 on the storage component 12 and can be selected to prevent leakage of the solutions through the sealing medium 50 during transport and/or storage of the storage component. The secondary sealing layer can be removed before the cartridge is assembled or can be left in place. A suitable material for the secondary sealing layer includes, but is not limited to, Mylar. The secondary sealing layer can be attached to the storage component with an adhesive or using surface tension.

Figure 5B:
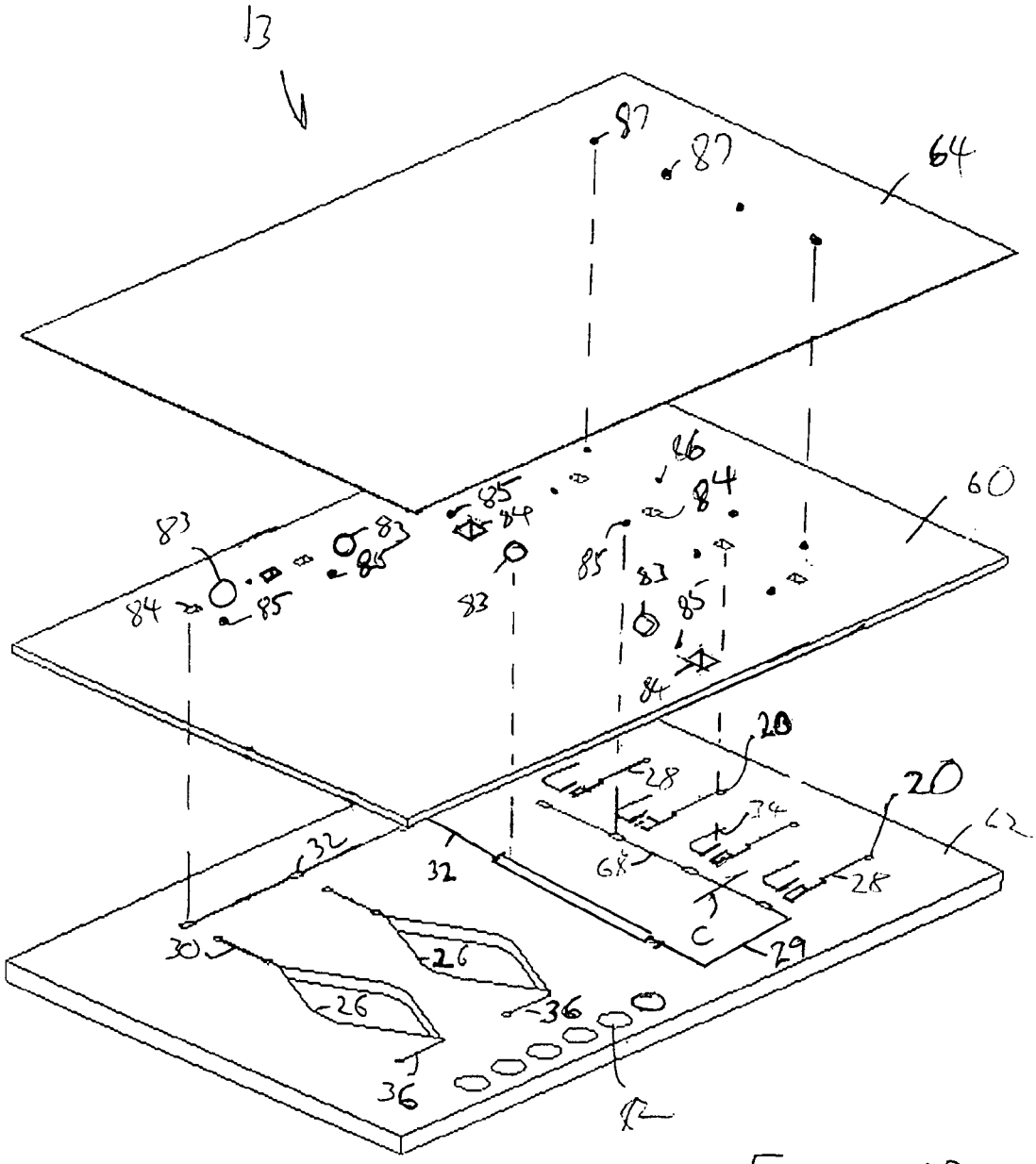
Figure 5C:
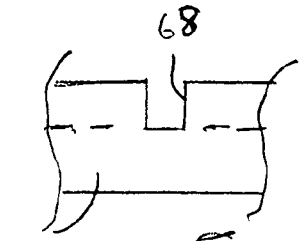

FIG. 5A through FIG. 5C illustrate a suitable construction for a transport component 13 configured to operate as disclosed with respect to FIG. 2. FIG. 5A is a perspective view of the parts of a transport component 13 before assembly of the transport component 13. FIG. 5B is a different perspective view of the parts of a transport component 13 before assembly of the transport component 13. The view of FIG. 5B is inverted relative to the view of FIG. 5A. The transport component 13 includes a base 60 positioned between a cover 62 and a flexible layer 64. FIG. 5C is a cross section of the cover 62 shown in FIG. 5B taken along the line labeled C.

The cover 62 includes a plurality of disruption mechanisms 16 extending from a common platform 66. Recesses 68 extend into the bottom of the cover 62 as is evident in FIG. 5B and FIG. 5C. As will become evident below, these recesses 68 define the top and sides of the transport channels and the product chambers 26 in the transport member. For instance, the sides of the recesses 68 serve as the sides of the channels and the sides of the product chamber. The cover 62 also include a plurality of openings 20 that each serve as the opening 20 to a lumen that leads to a disruption mechanism 16.

The base 60 includes a plurality of sensors 70 for detecting the presence and/or amount of an agent in a solution. The sensors 70 are positioned on the base 60 such that each sensor is positioned in a product chamber upon assembly of the transport component. The illustrated sensors include a working electrode 72, a reference electrode 74 and a counter electrode 76. In some instances, each of the electrodes is formed from a single layer of an electrically conductive material. Suitable electrically conductive materials, include, but are not limited to, gold. Electrical leads 78 provide electrical communication between each of the electrodes and an electrical contact 80. Other sensor constructions are disclosed in U.S.

patent application Ser. No. 09/848,727, filed on May 5, 2001, entitled "Biological Identification System with Integrated Sensor Chip and incorporated herein in its entirety.

Upon assembly of the transport component the electrical contacts 80 can be accessed through openings 82 that extend through the cover 62. Although not illustrated, the storage component can include a plurality of openings that align with the openings 82 so the electrical contacts 80 can be accessed through both the openings 82 in the transport component and the openings in the storage component. Alternately, the storage component can be configured such that the openings 82 in the transport component remain exposed after assembly of the cartridge. In these instances, the contacts can be accessed through the openings 82 in the transport component.

A plurality of reservoir openings 83 extend through the base 60. As will become evident below, the reservoir openings serve as an opening through which a liquid in a channel can enter and/or exit a variable volume reservoir. The mixing component includes a plurality of the variable volume reservoirs. Additionally, volume control devices can each include a variable volume reservoir.

A plurality of first valve channels 84 and second valve channels 85 extend through the base 60. As will become evident below, each first valve channel 84 is associated with a second valve channel 85 in that the first valve channel 84 and associated second valve channel 85 are part of the same valve. Additionally, the first valve channels 84 serve as valve inlets and the second valve channels 84 serve as valve outlets. Upon assembly of the transport component, first valve channels 84 for the first valves are aligned with an input channel 28 such that a solution flowing through an input channel can flow into the first valve channel and the associated second valve channels 85 are aligned with the first common channel such that a solution in the second valve channel can flow into the first common channel. Upon assembly of the transport component, the first valve channels 84 for the second valves are aligned with the second common channel such that a solution flowing through the second common channel can flow into the first valve channel and the associated second valve channels are aligned with an independent channel such that a solution in the second valve channel can flow into the independent channel. Upon assembly of the transport component, the first valve channels 84 for the inlet valve, the outlet valve, and the isolation valve are aligned with a portion of the second common channel such that a solution flowing through a portion of the second common channel can flow into the first valve channel and the associated second valve channels are aligned with an independent channel such that a solution in the second valve channel can flow into another portion of the second common channel.

First vent openings 86 also extend through the base 60. Upon assembly of the transport component the first vent openings 86 align with the vent channels 34 such that air in each vent channel 34 can flow through a first vent opening 86. The flexible layer 64 includes a plurality of second vent openings 87. The second vent openings 87 are positioned such that each second vent opening 87 aligns with a first vent opening 86 upon assembly of the transport component. As a result, air in each vent channel 34 can flow through a first vent opening 86 and then through a second opening. Accordingly, air in each vent channel can be vented to the atmosphere. In another embodiment, there is no vent opening 87 on flexible layer 64 and the air vented from vent channel 34 will be trapped between flexible layer 64 and vent channel 34.

Although FIG. 5A through FIG. 5D illustrates a sensor positioned in each of the product chambers upon assembly of the transport component, a sensor can be positioned in only one of the product chambers or in a portion of the product chambers. In some instances, none of the product chambers will include a sensor as is disclosed above.

Figure 5F:
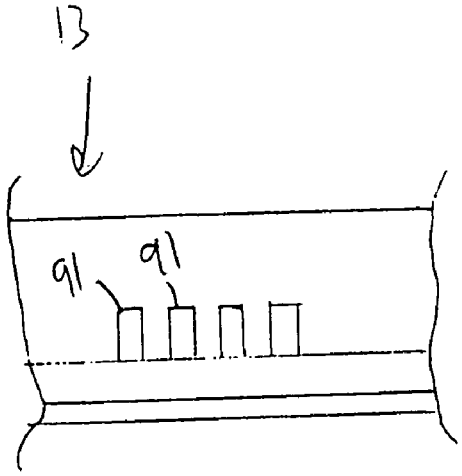
Figure 5E:
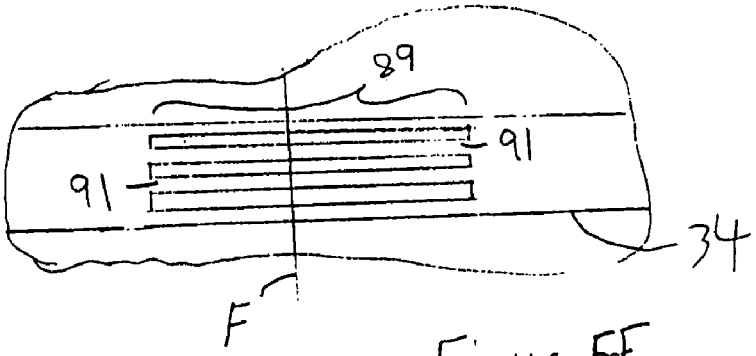
Figure 5D:
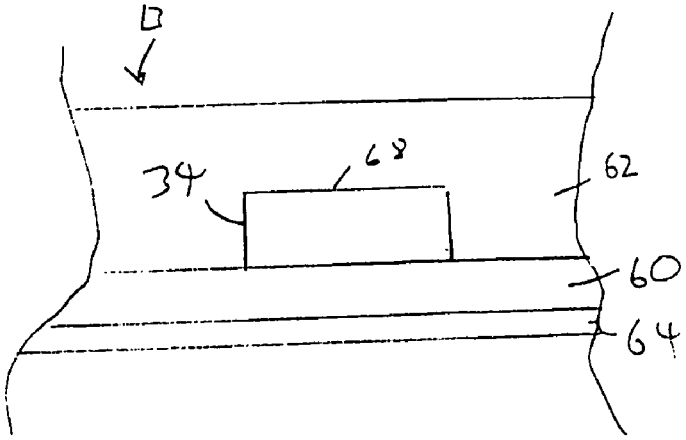

The transport component 13 can be assembled by attaching the base 60 to the cover 62 and the flexible layer 64. Upon assembly of the transport component 13, the channels are partially defined by the base 60 and the recesses 68 in the cover 62. For instance, FIG. 5D is a cross section of a portion of the transport component 13 having a vent channel 34. The cover 62 defines the top and sides of the vent channel 34 while the base 60 defines the bottom of the vent channel 34.

The transport component 13 is configured such that air can flow through the vent channels 34 while restricting solution flow through the vent channel 34. In some instances, the vent channels 34 are sized to allow airflow through the vent channel 34 while preventing or reducing the flow of solution through the vent channel 34.

In some instances, a vent channel 34 includes one or more constriction regions 89. The constriction region 89 can include a plurality of ducts, conduits, channels or pores through an obstruction in the vent channel. The ducts, conduits, channels or pores can each be sized to permit air flow while obstructing solution flow. For instance, FIG. 5E is bottom view of the portion of a cover 62 having a vent channel 34 with a constriction region 89. FIG. 5F is a cross section of the constriction region 89 taken at the line labeled F. The constriction region 89 includes a plurality of ducts 91 that are each sized to permit airflow while restricting or obstructing solution flow. In some instances, the ducts 91 each have a cross sectional area less than 0.01 $\mu m^2$. The use of multiple ducts 91 can increase the amount of airflow above the level that can be achieved with a single duct or a single channel configured to restrict solution flow. As a result, multiple ducts 91 can increase the efficiency with which air can flow through the vent channel 34. A constriction region 89 can be positioned anywhere along the vent channel 34 and multiple constriction regions can be used along a single vent channel 34. Additionally, the constriction region 89 can extend the entire length of the vent channel 34.

Alternatively or additionally, a membrane (not shown) can be positioned on the flexible layer 64 so as to cover one or more of the second vent openings 87. The membrane can be selected to allow the passage of air through the membrane while preventing the flow of solutions through the membrane. As a result, the membrane can obstruct solution flow through a vent channel 34. The membrane can be positioned locally relative to the second vent openings. For instance, the membrane can be positioned so as to cover one or more of the second vent openings. Alternately, the membrane can be a layer of material positioned on the flexible layer 64 and covering a plurality of the second vent openings 87. A suitable material for the membrane includes, but is not limited to PTFE or porous polymer. When a membrane is employed, the vent channel can also be configured to restrict solution flow but need not be. For instance, one or more constriction regions 89 can optionally be employed with the membrane.

The cover 62 illustrated in FIG. 5A includes a plurality of waste outlet structures 93 extending from the common platform 66. These outlet structures align with the waste channels 36 upon assembly of the transport component and provide an outlet for waste solution from a product chamber. The outlet structures can be a piercing mechanism that pierces an empty reservoir 14 on the storage component upon assembly of the cartridge. In these instances, the waste solution flows into the reservoir 14 during operation of the cartridge. Alternately, the outlet structures can be accessible above the cartridge. For instance, the outlet structures can extend through or around the storage component. In these instances, the outlet structures can be connected to a tube or other device that carries the waste solution away from the cartridge. The outlet structures need not be present on the storage device. In these instances, the transport component can include an internal reservoir into which the waste solutions can flow. For instance, the base 60 and the cover 62 can define a waste reservoir into which the waste channels 36 flow.

The cover 62 and the base 60 can be formed by techniques including, but not limited to, injection molding or thermal forming. A suitable material for the cover 62 and base 60 include, but are not limited to polycarbonate or polyethylene. A suitable flexible layer 64 includes, but is not limited to, an elastic membrane or silicone. Suitable techniques for bonding the cover 62 and the base 60 include, but are not limited to, laser welding, thermal bonding or using an adhesive. A variety of technologies can be employed to bonding the base 60 and the flexible layer 64. For instance, laser welding can be used to bond the base 60 and the flexible layer 64. As will become evident below, there are regions of the transport component where the flexible layer 64 is not bonded to the transport component. These regions can be formed through the use of a shadow mask in conjunction with laser welding. The electrodes, electrical contacts and electrical leads can be formed on the base using integrated circuit fabrication technologies.

Figure 6A:
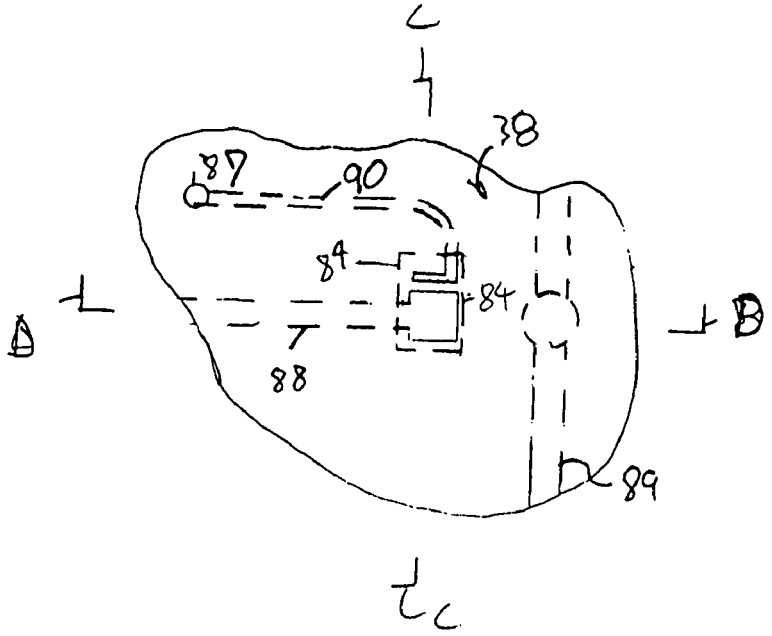
FIG. 6A through FIG. 6E illustrates a valve formed upon assembly of the transport component.
Figure 6B:
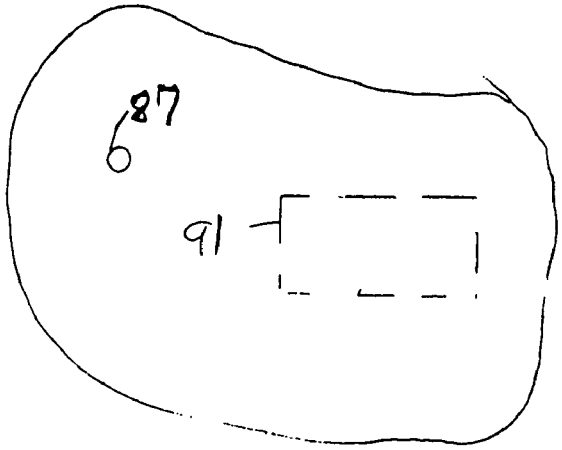
Figure 6C:
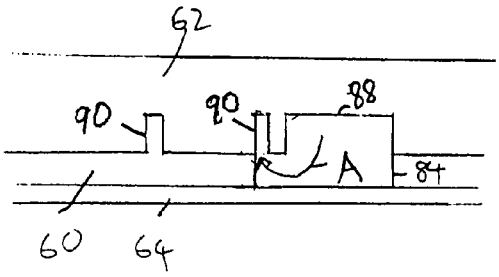
Figure 6D:
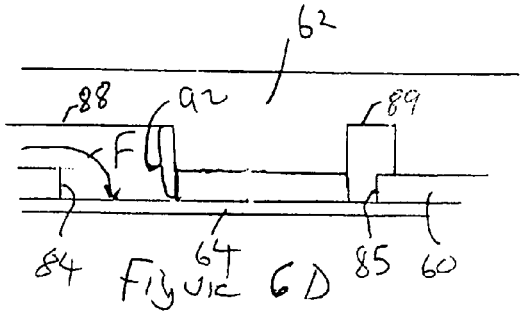

The cover 62, the base 60 and the flexible layer 64 form the valves in the transport mechanism. FIG. 6A through FIG. 6E illustrate one of the valves formed upon assembly of the transport component shown in FIG. 5A and FIG. 5B. FIG. 6A is a topview of the portion of the transport component that includes the valve. The dashed lines illustrate items that are positioned in the interior of the transport component. FIG. 6B is a bottom view of the portion of the transport component shown in FIG. 6A. The dashed lines in FIG. 6B illustrate the location of a valve region 91 where the flexible layer 64 is not attached to the base 60. FIG. 6C is a cross section of the cartridge shown in FIG. 6A taken along a line extending between the brackets labeled C. FIG. 6D is a cross section of the cartridge shown in FIG. 6A taken along a line extending between the brackets labeled D.

A first valve channel 84 in the base 60 is aligned with an input channel 88 in the cover 62 such that a solution in the input channel can flow into the first valve channel. Accordingly, the first valve channel 84 defines a portion of the input channel. A second valve channel 85 in the base 60 is aligned with an output channel 89 in the cover 62 such that a solution in the second valve channel can flow into the output channel. The base 60 and the cover 62 act together to form an obstruction 92 between the input channel 88 and the output channel 89. Additionally, the cover provides a second obstruction between the input channel and the vent channel. The flexible material is positioned over the obstruction 92, the first valve channel and the second valve channel. As a result, the flexible material is positioned over a portion of the input channel and a portion of the output channel. Further, the flexible material is positioned over a portion of the vent channel.

Figure 6E:
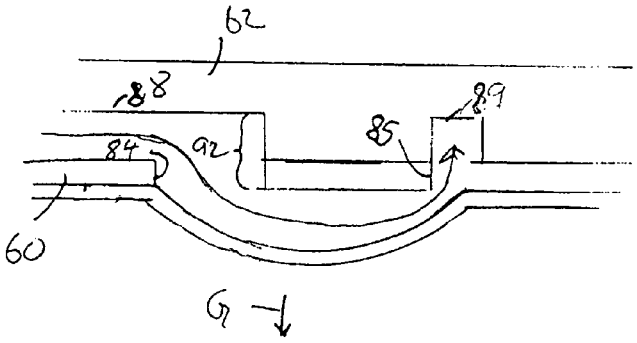

FIG. 6D through FIG. 6E illustrate operation of the valve. The desired direction of the solution flow through the valve is illustrated by the arrow labeled F in FIG. 6D. The flexible layer 64 is positioned close enough to the obstruction 92 that the solution does not flow around the obstruction 92 before a threshold pressure is applied to the solution upstream of the valve. As a result, FIG. 6D illustrates the valve before the solution flows through the valve. As the solution flows toward the valve, air in the input channel 88 can exit the input channel 88 through the vent channel 90 as illustrated by the arrow labeled A in FIG. 6C. The vent channel 90 is constructed such that the air can flow through the vent channel 90. In some instances, solution can also flow through all or a portion of the vent channel length. In instances where solution flows into the vent channel, one or more constriction regions can option be positioned along the vent channel as discussed in the context of FIG. 5. As a result, the vent channel 90 allows air and/or other gasses to be vented from the input channel 88. A portion of the vent channel 90 is shown as being parallel to the input channel 88 in the valve region. The parallel nature of the vent channel 90 allows the air to continue draining while the valve region fills with solution.

During operation of the valve, the displacement between the flexible layer 64 and the obstruction 92 changes. For instance, as the valve opens from a closed position or as the valve opens further, the flexible layer 64 moves away from the obstruction 92 as shown in FIG. 6E. The movement of the flexible layer 64 away from the obstruction 92 increases the volume of a fluid path around the obstruction 92. Once the upstream pressure on the solution passes a threshold pressure or the flexible membrane is pulled down by an external force, the solution begins to flow through the fluid path around the obstruction 92 as illustrated by the arrow labeled F in FIG. 6E. Accordingly, the movement of the flexible layer away from the obstruction allows the solution to flow from the input channel 88 into the output channel 89.

Figure 7A:
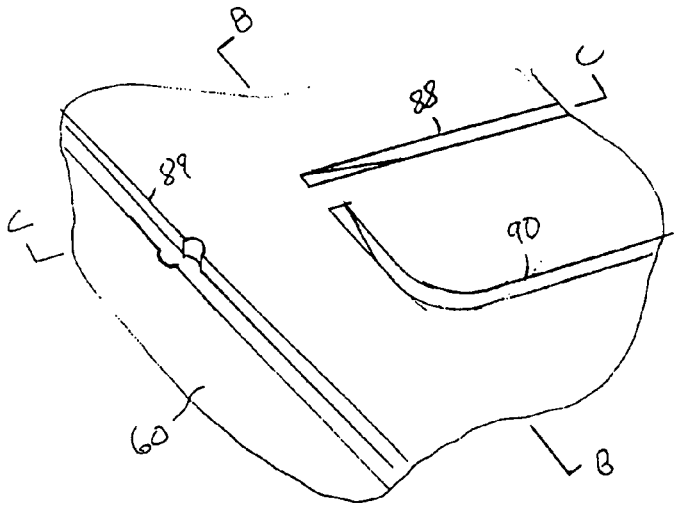
FIG. 7A through FIG. 7D through illustrate another embodiment of a valve suitable for use with the cartridge.
Figure 7B:
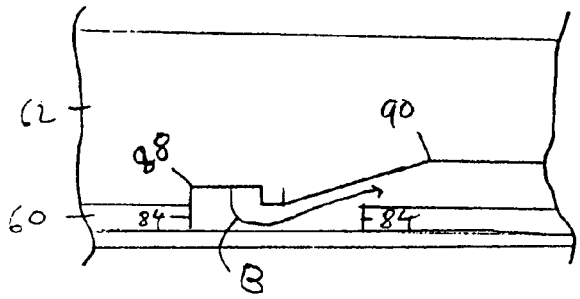
Figure 7C:
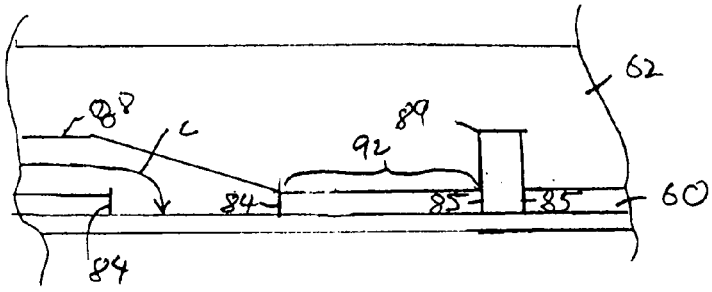

FIG. 7A through FIG. 7C illustrate another embodiment of a valve suitable for use with the cartridge. FIG. 7A is a perspective view of the portion of the cover that includes the valve. FIG. 7B illustrates a cross section of a transport component that includes the cover 62 shown in FIG. 7A taken along a line extending between the brackets labeled B. FIG. 7C illustrates a cross section of a transport component that includes the cover 62 shown in FIG. 7A taken along a line extending between the brackets labeled C.

A first valve channel 84 in the base 60 is aligned with an input channel 88 in the cover 62 such that a solution in the input channel can flow into the first valve channel. Accordingly, the first valve channel 84 defines a portion of the input channel. A second valve channel 85 in the base 60 is aligned with an output channel 89 in the cover 62 such that a solution in the second valve channel can flow into the output channel. Accordingly, the second valve channel 84 defines a portion of the output channel. The base 60 and the cover 62 act together to form an obstruction 92 between the input channel 88 and the output channel 89. Additionally, the cover provides a second obstruction between the input channel and the vent channel. The flexible material is positioned over the obstruction 92, the first valve channel and the second valve channel. As a result, the flexible material is positioned over a portion of the input channel and a portion of the output channel. Further, the flexible material is positioned over a portion of the vent channel.

Figure 7D:
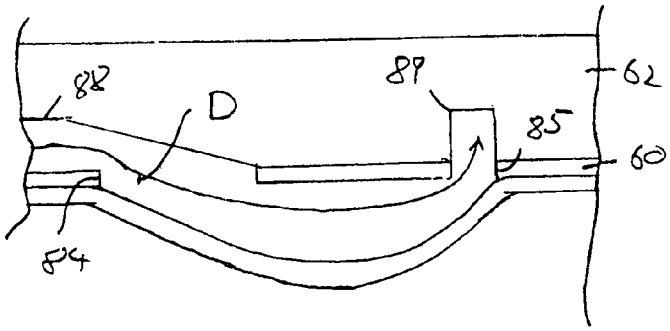

FIG. 7B and FIG. 7D illustrate operation of the valve. The desired direction of the solution flow through the valve is illustrated by the arrow labeled C in FIG. 7C. The flexible layer 64 is positioned close enough to the obstruction 92 that the solution does not flow around the obstruction 92 before a threshold pressure is applied to the solution upstream of the valve. As a result, FIG. 7C illustrates the valve before the solution flows through the valve. As the solution flows toward the valve, air in the input channel 88 can exit the input channel 88 through the vent channel 90 as illustrated by the arrow labeled B in FIG. 7B. In some instances, solution can also flow into the vent channel. In instances where solution flows into the vent channel, one or more constriction regions can option be positioned along the vent channel as discussed in the context of FIG. 5. Accordingly, the vent channel 90 can be constructed such that the air can flow through the vent channel 90 but the solution is prevented from flowing through the vent channel 90. As a result, the vent channel 90 allows the air to drain from the input channel 88.

When the valve opens, the flexible layer 64 moves away from the obstruction 92 as shown in FIG. 7D. The movement of the flexible layer 64 away from the obstruction 92 creates a fluid path around the obstruction 92. Once the upstream pressure on the solution passes a threshold pressure or the flexible membrane is pulled down by external force, the solution begins to flow through the fluid path around the obstruction 92 as illustrated by the arrow labeled D in FIG. 7D. Accordingly, the movement of the flexible layer away from the obstruction allows the solution to flow from the input channel 88 into the output channel 89.

One or more of the channels that intersect at the valve can have a volume that decreases as the channel approaches the valve. The portion of a channel opposite the flexible material can slope toward the flexible material as the channel approaches the valve as is evident in FIG. 7C. For instance, the portion of the input channel 88 that ends at the valve can have a height that tapers in a direction approaching the valve. The height of a channel is the height of the channel at a point along the channel being measured in a direction perpendicular to the flexible material and extending from the flexible material across the channel to the point of the opposing side located furthest from the flexible material. The slope reduces the nearly perpendicular corner that can be formed between the side and bottom of an input channel 88 at location where the channel ends at the valve. A sharp corner can serve as a pocket where air can be caught. The slope can help to smooth the corner and can accordingly reduce formation of air bubbles in these pockets.

FIG. 7A through FIG. 7D also show the height of the vent channel 90 tapering toward the valve. This taper can prevent the formation of air pockets in the vent channel 90. Although FIG. 7A through FIG. 7D show tapers in the height of the input channel 88 and the vent channel 90, the valve can be constructed such that neither the input channel 88 nor the vent channel 90 includes a taper; such that the input channel 88 includes the taper and the vent channel 90 excludes the taper; or such that the vent channel 90 includes the taper and the input channel 88 excludes the taper.

The portion of the vent channel 90 closest to the input channel 88 at the valve can be parallel to the adjacent portion input channel 88 as is evident in FIG. 7A. The length of the parallel portion can optionally be about the same as the width of the adjacent portion of the input channel 88. This construction can reduce the formation of air bubbles in the valve.

The arrangement of the input channel 88, the output channel 89 and the vent channel 90 relative to one another can be changed from the arrangement illustrated in FIG. 6A through FIG. 7D. For instance, the portion of the output channel and the input channel 88 at the intersection of the channel can both be parallel to the output channel as illustrated by the valve labeled V in FIG. 2. Although FIG. 2 illustrates the valve positioned part way along the input channel, the valve can be constructed so the valve is positioned at an intersection of the input channel, vent channel and common channel. The flexibility in channel arrangement can increase the number of features that can be placed on a single cartridge.

In some instances, the second valve channel has a substantially round shape as evident in FIG. 6A. The round shape may have a diameter that is larger than the width of the output channel. In these instances, the output channel can optionally have a bulge as is evident in FIG. 6A and FIG. 7A. The bulge can be configured to make the walls of the output channel substantially flush with the walls of the second valve channel. The flush nature can reduce the formation of air pockets that can result from formation of a step between the walls of the output channel and the walls of the second valve channel.

The valves disclosed in FIG. 6A through FIG. 7D can be the first valves 38 described in the context of FIG. 2. When the valve serves as a first valve 38, an input channel 28 can be the input channel 88, the first common channel 29 can be the output channel 89, and a vent channel 34 can be the vent channel 90. Alternately, the valve can be positioned part way along the input channel. For instance, a portion of an input channel 28 can be the input channel 88, another portion of the input channel 28 can be the output channel 89, and a vent channel 34 can be the vent channel 90.

The valves disclosed in FIG. 6A through FIG. 7D can be adapted to serve as the second valve 40, the inlet valve 41, the outlet valve 42, and/or the isolation valve 43 described in the context of FIG. 2 by removing the vent channel 34 from the valve. When the valve serves as a second valve 40, the second common channel 32 can be the input channel 88 and an independent channel 30 can be the output channel 89. Alternately, the valve can be positioned part way along the independent channel 30. For instance, a portion of an independent channel 30 can be the input channel 88, another portion of the independent channel 30 can be the output channel 89.

Although the transport component illustrated in FIG. 5A and FIG. 5B includes valves constructed according to FIG. 6A through FIG. 6E, one of the valves, more than one of the valves or all of the valves can be constructed according to FIG. 7A through FIG. 7E.

The above valves can be opened by increasing the upstream pressure on the solution enough to deform the flexible layer 64 and/or by employing an external mechanism to move the flexible layer 64 away from the obstruction 92. The upstream pressure can be increased by compressing the reservoir 14 that contains a solution in fluid communication with the input channel. An example of a suitable external mechanism is a vacuum. The vacuum can be employed to pull the flexible layer 64 away from the obstruction 92.

Although the flexible layer 64 is illustrated as being in contact with the obstruction 92, the transport component can be constructed such that the flexible layer 64 is spaced apart from the obstruction 92 when the positive pressure is not applied to the upstream solution. A gap between the flexible layer 64 and the obstruction 92 can be sufficiently small that the surface tension of the solution prevents the solution from flowing past the obstruction 92 until a threshold pressure is reached. In these instances, the movement of the flexible layer 64 away from the obstruction 92 serves to increase the volume of the path around the obstruction 92.

The threshold pressure that is required to generate solution flow through the valve can be controlled. A stiffer and/or thicker flexible layer 64 can increase the threshold pressure. Moving the flexible layer 64 closer to the obstruction 92 when the positive pressure is not applied to the upstream solution can increase the threshold pressure. Decreasing the size of one or more of the valve channels 84 can narrow the fluid path around the obstruction 92 can also increase the threshold pressure. Further, in creasing the size of one or more of the valve channels 84 can increase the volume of the path around the obstruction 92 can also reduce the threshold pressure.

The relative size of the inlet valve channel 84 and the outlet valve channel 85 can also play a role in valve performance. For instance, a ratio of the cross-sectional area of the outlet valve channel 85 to cross-sectional area of the inlet valve channel 84 can affect valve performance. Back flow through the valve can be reduced when this ratio is less than one. Additionally, reducing the ratio serves to reduce the backflow. In some instances, the input channel and/or the outlet channel has more than one flow path. For instance, the outlet flow channel can include a plurality of holes through the base. In these instances, the cross sectional area of the outlet channel is the sum of the total cross sectional area of each of the flow paths.

Although the valve is disclosed in the context of a valve positioned between an input channel and a common channel 32, the illustrated valve construction can be applied to the other valves in the transport component.

Although the above illustrations show the vent channel 34 as being connected to the valve, vent channels 34 can be positioned at a variety of other locations. For instance, a vent channel 34 can be positioned in the input channel before the valve.

Although the transport components of FIG. 5A and FIG. 5B illustrate a single flexible material forming each of the valves, the transport component can include more than one flexible material and each of the flexible material can be included in one valve or in more than one valve.

Figure 8A:
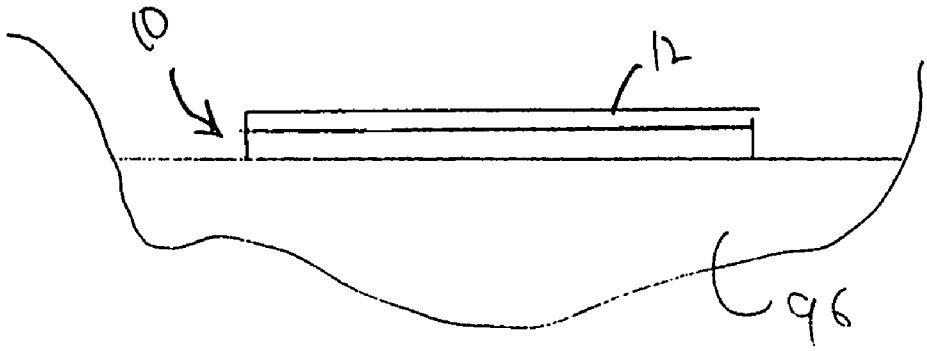
FIG. 8A and FIG. 8B illustrate operation of the cartridge.
Figure 8B:
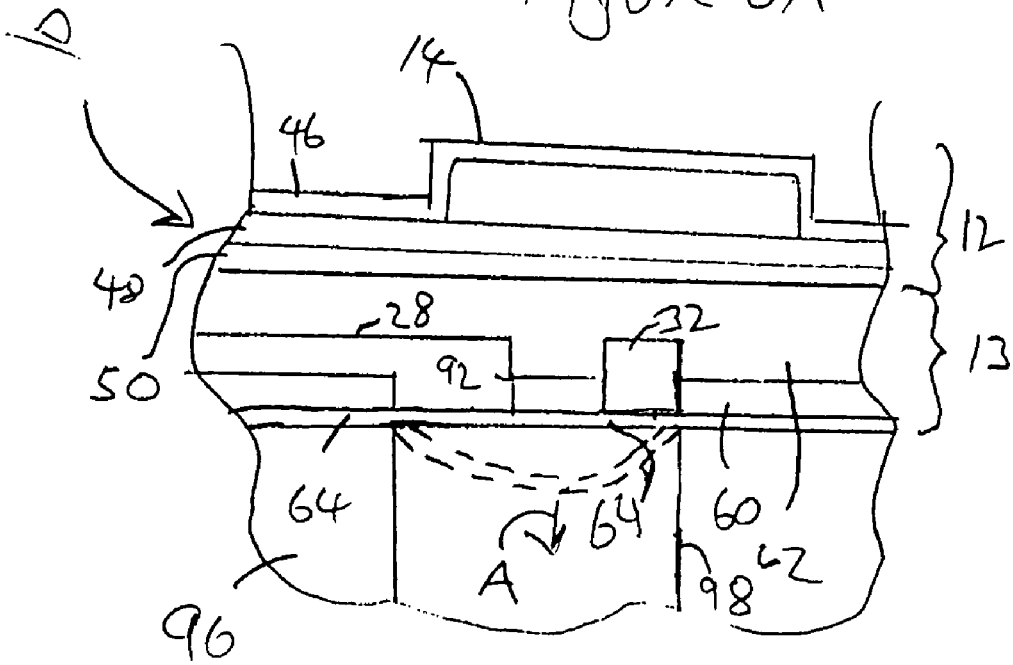

FIG. 8A and FIG. 8B illustrate operation of the cartridge constructed as disclosed above with an external mechanism employed to move a flexible layer 64 away from an obstruction 92 in a valve. FIG. 8A is a sideview of a system including the cartridge positioned on a manifold 96. In some instances, the cartridge is immobilized on the manifold. A variety of different devices can be employed to immobilize the cartridge on the manifold. FIG. 8B is a cross section of the system shown in FIG. 8A. The manifold 96 includes a plurality of ports 98. The ports are aligned with the valves on the cartridge. The manifold 96 is configured such that a vacuum can be independently pulled on one or more ports. The amount of vacuum pulled at a port 98 can be sufficient to completely or partially open the valve aligned with that port as illustrated by the dashed line and the arrow labeled A in FIG. 8B. As a result, the manifold 96 can be employed to selectively open the valves on the cartridge. Additionally or alternately, the manifold can be configured to generate a positive pressure on a port. The positive pressure can keep a valve closed during operation of the cartridge. For instance, the manifold can be operated so as to keep the outlet valve closed while a solution is flowed into the mixing component.

Although a manifold 96 is disclosed in FIG. 8A and FIG. 8B, a cartridge constructed as disclosed above may operate without the use of an external mechanism for opening and closing of the valves. As a result, the manifold 96 is optional.

Figure 9A:
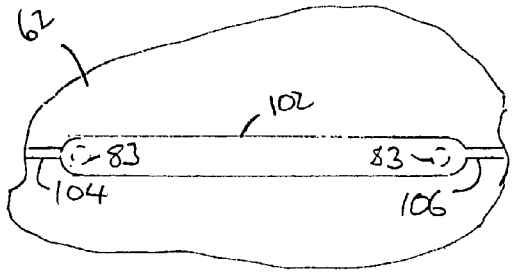
FIG. 9A through FIG. 9D illustrate a mixing component formed upon assembly of the transport component shown in FIG. 5A and FIG. 5B.
Figure 9B:
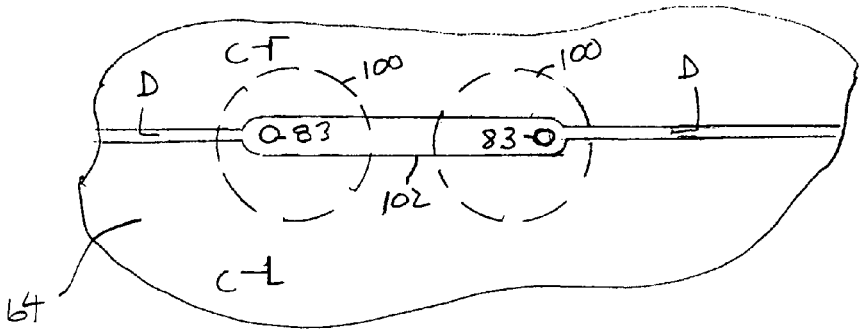
Figure 9C:
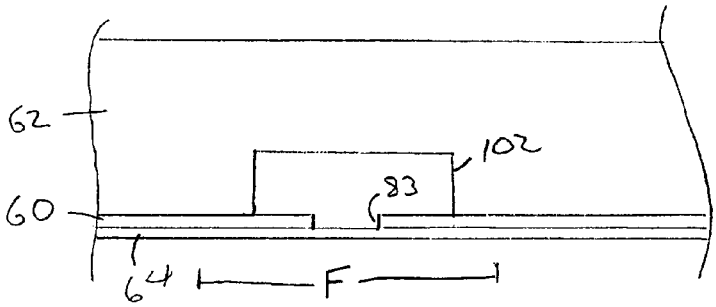
Figure 9D:
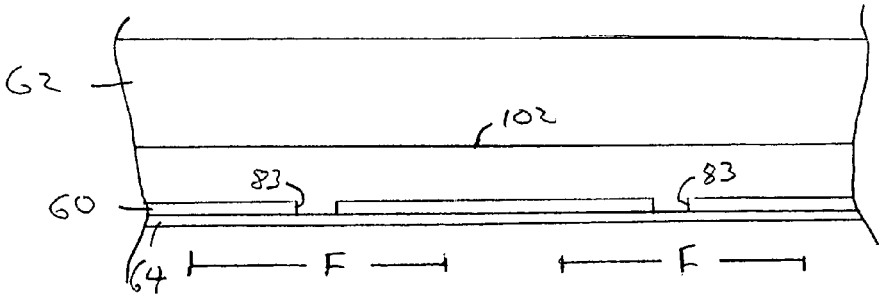

FIG. 9A through FIG. 9D illustrate a mixing component formed upon assembly of the transport component shown in FIG. 5A and FIG. 5B. FIG. 9A is a top-view of the portion of the transport component that includes the mixing component. FIG. 9B is a bottom view of the portion of the transport component shown in FIG. 9A. FIG. 9C is a cross section of the cartridge shown in FIG. 9B taken along a line extending between the brackets labeled C. FIG. 9D is a cross section of the cartridge shown in FIG. 9B taken along a line extending between the brackets labeled D. For the purposes of illustration, the transport component is treated as transparent in FIG. 9A. Accordingly, the solid lines in FIG. 9A illustrate features that are included on the cover 62 but that are located in the interior of the transport component. Additionally, the dashed lines in FIG. 9A illustrate items that are positioned in the interior of the transport component on the base 60. The component is again treated as transparent in FIG. 9B. The solid lines show the features that are included on the cover 62 and on the base 60 in the interior of the transport component.

Figure 9E:
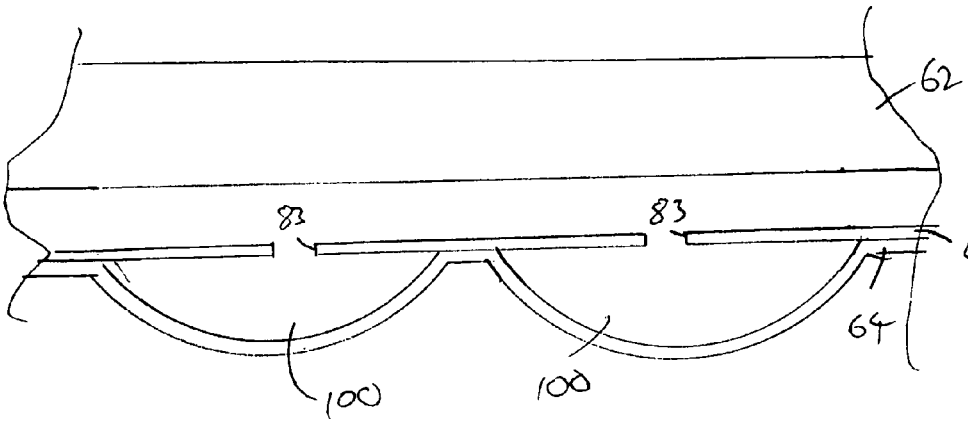
FIG. 9E illustrates the mixing component of FIG. 9D where each of the variable volume reservoirs contains a solution.

The mixing component includes a plurality of variable volume reservoirs. The dashed lines in FIG. 9B illustrate the perimeter of the variable volume reservoirs 100 where the flexible layer 64 is not attached to the base 60. The brackets labeled F in FIG. 9C and FIG. 9D indicate the locations where the flexible layer 64 is not attached to the base 60 and accordingly illustrate the location of the variable volume reservoirs. The variable volume reservoirs illustrated in FIG. 9A through FIG. 9D are illustrated with a zero volume. FIG. 9E illustrates the mixing component of FIG. 9D where each of the variable volume reservoirs contains a solution. Accordingly, each of the variable volume reservoirs contains a non-zero volume.

The mixing component includes two variable volume reservoirs 100. A mixing channel 102 provides liquid communication between the variable volume reservoirs 100. The mixing channel 102 can have a cross-sectional area that is larger than the cross sectional area of the inlet channel 104 and/or the outlet channel 106. A reservoir opening 83 extends through base 60 and is positioned in the mixing channel 102. Accordingly, the reservoir opening 83 serves as a conduit through which solution can enter the variable volume reservoir 100 from the mixing channel 102 and/or enter the mixing channel from the variable volume reservoir. As will be described in more detail below, multiple mechanisms are available for increasing and decreasing the volume of a variable volume reservoir.

Figure 9F:
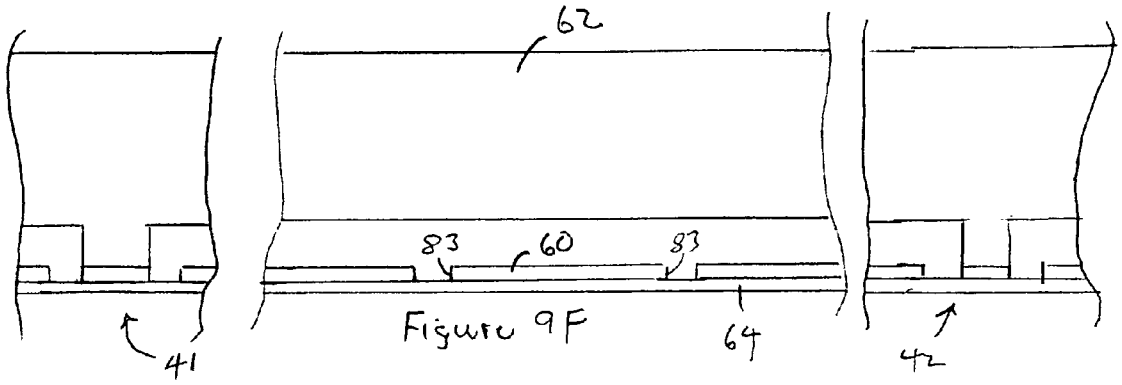
FIG. 9F through FIG. 9K illustrate a method of operating the mixing component so as to mix solutions.

FIG. 9F through FIG. 9K illustrate a method of operating the mixing component so as to mix solutions. FIG. 9F is a cross section of the mixing component. The inlet valve 41 and the outlet valve 42 are also illustrated in FIG. 9F. Although the inlet valve 41 and the outlet valve 42 are shown as being separate from the mixing component, the inlet valve 41 and/or the outlet valve 42 can be incorporated into the mixing component.

Figure 9G:
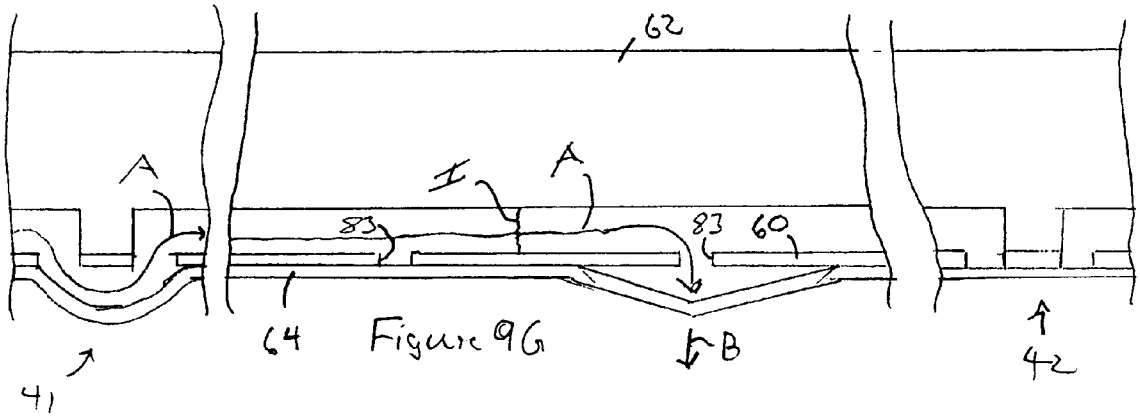

During the transport of a plurality of solutions into the mixing component, the outlet valve 42 is closed and the inlet valve is opened as shown in FIG. 9G. A first solution is transported through the inlet valve 41 and into the mixing component as illustrated by the arrows labeled A. The variable volume reservoirs can be operated so the first solution flows into both of the variable volume reservoirs or so the first solution flows into one of the variable volume reservoirs. The illustrated method shows the variable volume reservoirs operated so the first solution flows one of the variable volume reservoirs and accordingly increases the volume of the variable volume reservoir as illustrated by the arrow labeled B. After the desired volume of the first solution is transported into the mixing component, a second solution is transported through the inlet valve 41 and into the mixing component. The interface between the first solution and the second solution is illustrated by the line labeled I in FIG. 9G. The desired volume of the second solution is transported into the mixing component. Additional solutions can optionally be transported into the mixing component. The various solutions combine to form a product solution in the mixing component.

Figure 9H:
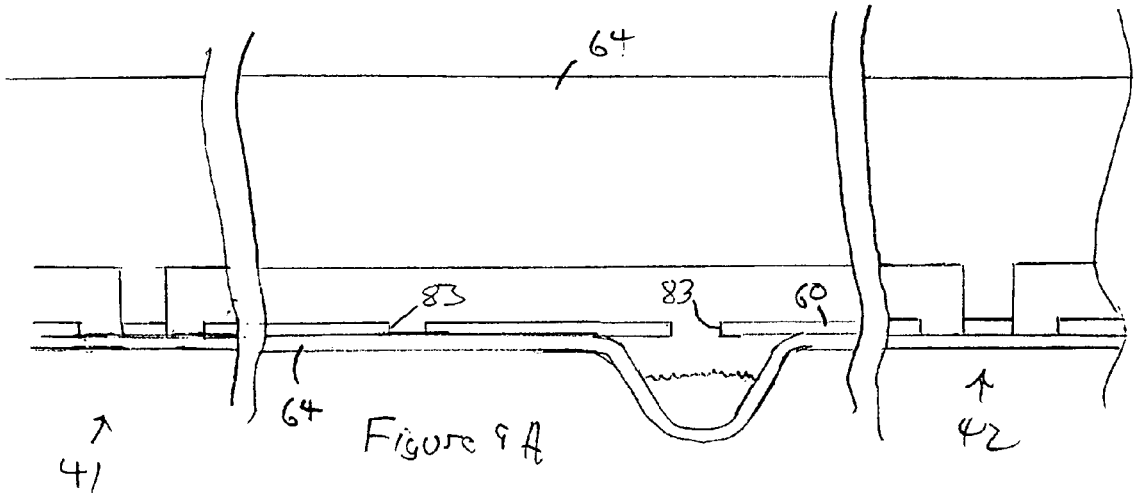

After the desired number of solutions is transported into the mixing component, the inlet valve is closed as shown in FIG. 9H. The closure of the inlet valve 41 and the outlet valve 42 as shown in FIG. 9H helps isolate the solutions in the mixing component from other regions of the cartridge during the mixing process.

Figure 9I:
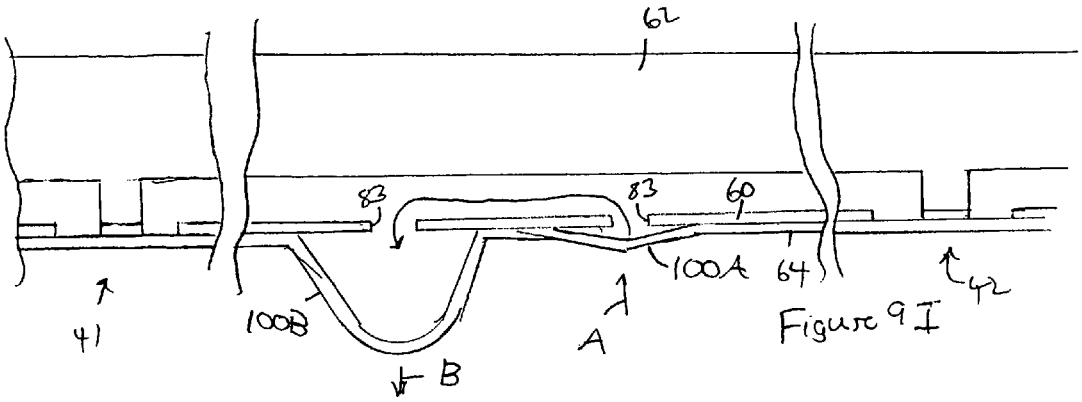

The volume of the first variable volume reservoir 100A is decreased as shown by the arrow labeled A in FIG. 9I. Additionally or alternately, the volume of the second variable volume reservoir 100B can be increased as shown by the arrow labeled B in FIG. 9I. The result of these actions is transport of at least a portion of the product solution from the first variable volume reservoir 100A into the second variable volume reservoir 100B.

Figure 9J:
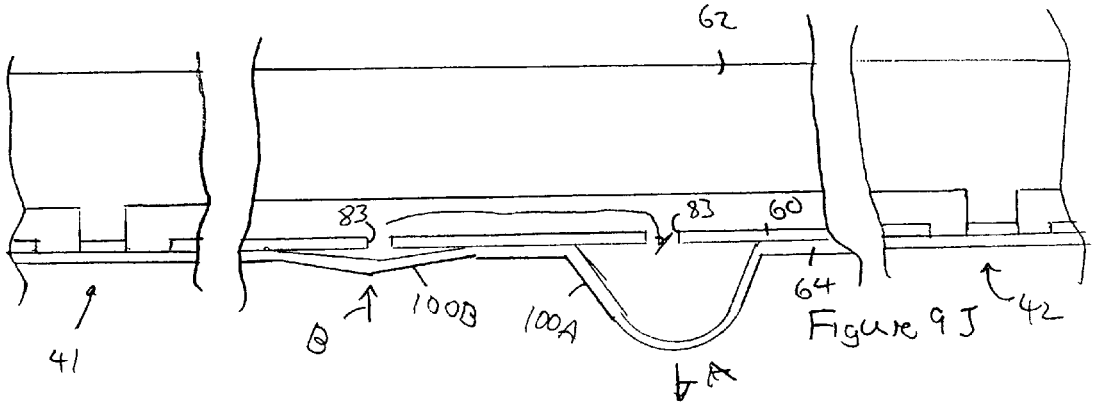
Figure 9K:
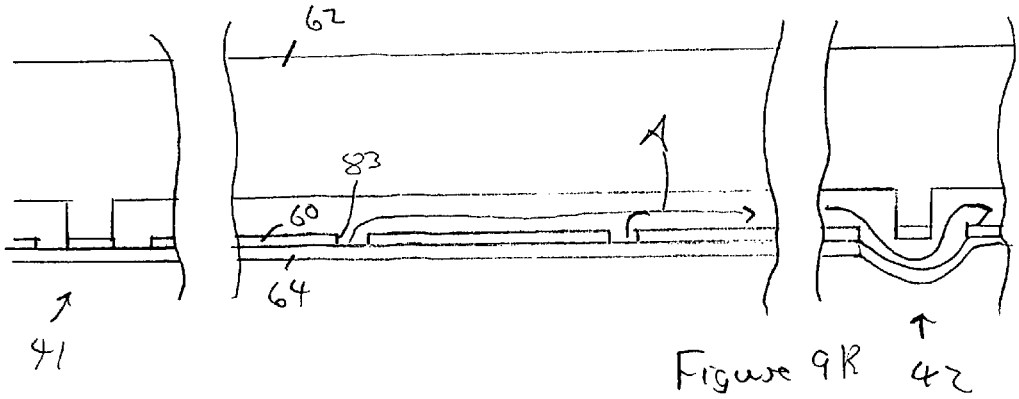

The above steps can be reversed to transport at least a portion of the product solution back into the first variable volume reservoir as shown in FIG. 9J. For instance, the volume of the first variable volume reservoir 100A can be increased as shown by the arrow labeled A in FIG. 9I. Additionally or alternately, the volume of the volume of the second variable volume reservoir 100B can be decreased as shown by the arrow labeled B in FIG. 9J. The result of these actions is transport of at least a portion of the product solution from the second variable volume reservoir 100B into the first variable volume reservoir 100A.

The transport of the product solution back and forth between the variable volume reservoirs causes the solutions to be mixed. The quality of the mixing increases as the number of cycles increases. For instance, the product solution is preferably transported into one of the variable volume reservoirs at least 1 times, 10 times, or 100 times. Accordingly, the product solution is cycled between the variable volume reservoirs until the desired degree of mixing is achieved. Once the desired degree of mixing is achieved, the outlet valve is opened and the volume of the variable volume reservoirs is decreased. The decrease in volume transports the product solution out of the mixing component as shown by the arrow labeled A in FIG. 9K.

In the method described above, the inlet valve reduces backflow of the solutions through the inlet channels toward the storage reservoirs in the storage component. However, this function can also be achieved with the first valves. As a result, the inlet valve is optional.

The illustrated mixing component optionally has the advantage that it can be bypassed. For instance, each of the variable volume reservoirs can be in the closed position while a solution is transported through the mixing component. As a result, the solution flows through the mixing component without flowing into the variable volume reservoirs.

Other configurations for the channels leading to and from the mixing component are possible. For instance, multiple inlet channels can transport solution into the mixing channel. However, the configuration of a mixing component with single inlet channel and a single outlet channel reduces the complexity of operating the mixing component.

Figure 9L:
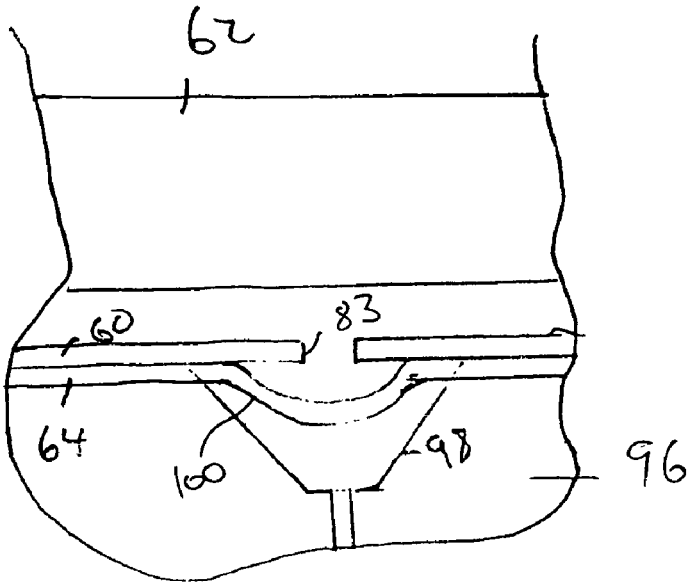
FIG. 9L and FIG. 9M illustrate the use of a device external to the cartridge for changing the volume of the variable volume reservoirs.
Figure 9M:
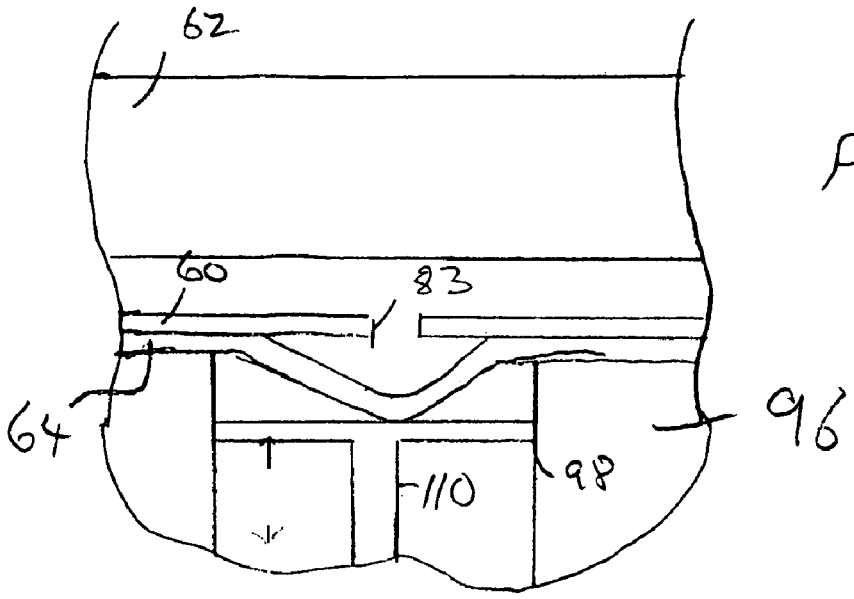

The above method requires increasing and/or decreasing the volume of the variable volume reservoir. A variety of mechanisms can be employed to increases and/or decrease the volume of a variable volume reservoir. For instance, FIG. 9L illustrates the cartridge positioned on the manifold 96 of FIG. 8A. In some instances, the cartridge is immobilized on the manifold. A variety of different devices can be employed to immobilize the cartridge on the manifold. The manifold 96 includes a ports 98 aligned with a variable volume reservoir 100. The manifold 96 is configured such that a vacuum can be pulled through the port. The amount of vacuum pulled at the port 98 can be sufficient to increase the volume of the variable volume reservoir 100. Additionally or alternately, the manifold can be configured to generate a positive pressure in the port. The positive pressure can be sufficient to decrease the volume of a variable volume reservoir and/or to keep a variable volume reservoir closed. Additionally or alternately, the port 98 can include a mechanical device 110 for manipulating the flexible layer 64 as shown in FIG. 9M. The device 110 can push on the flexible layer 64 toward the base 60 such that the volume of the variable volume reservoirs is decreased and/or pull the flexible layer 64 away from the base 60 such that the volume of the variable volume reservoirs is increased. Suitable mechanical devices include, but are not limited to, magnetic actuators, electrical actuators and pneumatic actuators.

When an external device such as a manifold is employed to change the volume of a variable volume reservoir, a variety of mechanisms can be employed to transport the solution into the variable volume reservoir. For instance, the volume of a variable volume reservoir can be increased while the solution is in a transport channel in liquid communication with the variable volume reservoir. The increasing volume of the variable volume reservoir will draw the solution into the variable volume reservoir. Alternately, the volume of the variable volume reservoir can be increased before the solution is in a transport channel in liquid communication with the variable volume reservoir. The solution can then flow into the open variable volume reservoir.

In some instances, an external device such as a manifold is not needed to change the volume of a variable volume reservoir. For instance, the pressure on a solution in a transport channel having a conduit to a variable volume reservoir can be increased until the solution flows into the variable volume reservoir and increases the volume of the variable volume reservoir. Alternately, the pressure on a solution in a transport channel having a conduit to a variable volume reservoir can fall until the solution flows out the variable volume reservoir and decreases the volume of the variable volume reservoir.

Figure 10A:
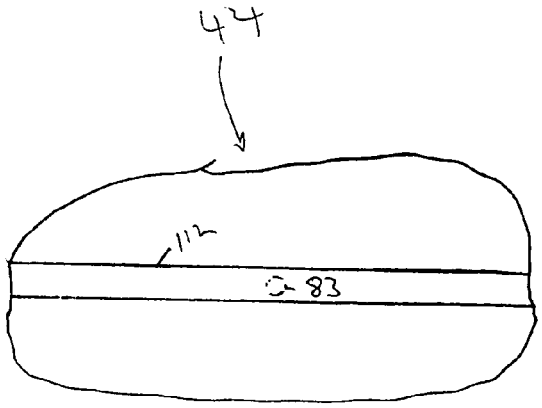
FIG. 10A through FIG. 10D illustrate a volume control device that is formed upon assembly of the transport component shown in FIG. 5A and FIG. 5B.
Figure 10B:
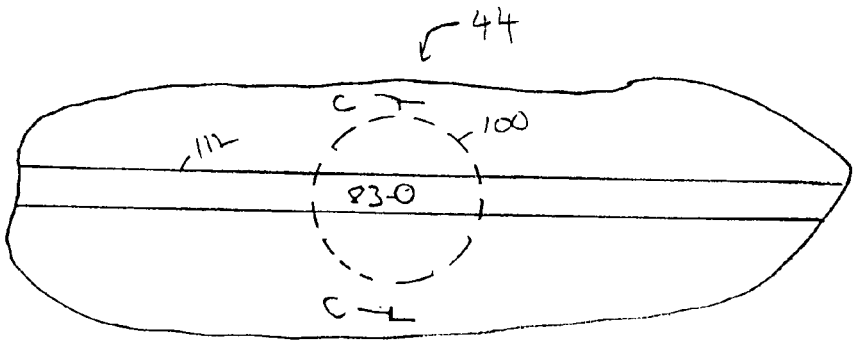
Figure 10C:
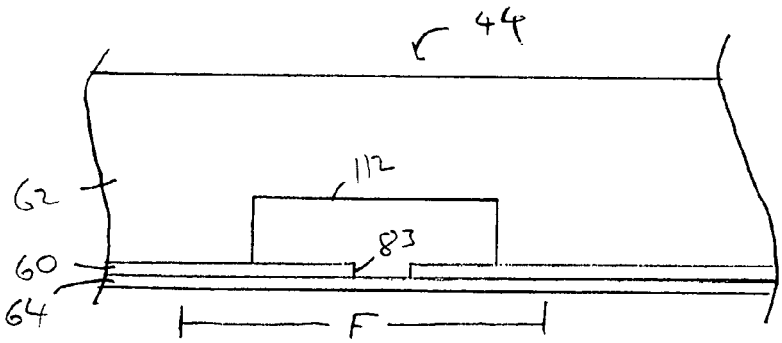

FIG. 10A through FIG. 10D illustrate a volume control device 44 that is formed upon assembly of the transport component shown in FIG. 5A and FIG. 5B. FIG. 10A is a top-view of the portion of the transport component that includes the volume control device 44. FIG. 10B is a bottom view of the portion of the transport component shown in FIG. 10A. FIG. 10C is a cross section of the cartridge shown in FIG. 10B taken along a line extending between the brackets labeled C. For the purposes of illustration, the transport component is treated as transparent in FIG. 10A. Accordingly, the solid lines in FIG. 10A illustrate features that are included on the cover 62 but that are located in the interior of the transport component. Additionally, the dashed lines in FIG. 10A illustrate items that are positioned in the interior of the transport component on the base 60. In FIG. 10B, the transport component is again treated as transparent. The solid lines show the features that are included on the cover 62 and on the base 60 in the interior of the transport component.

Figure 10D:
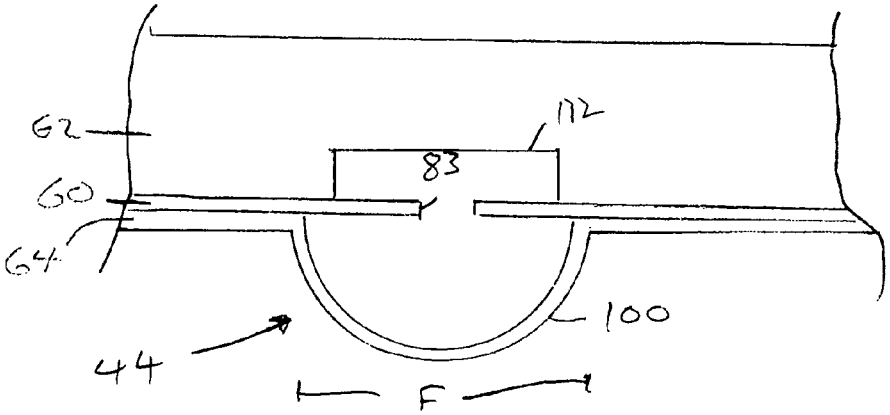

The volume control device includes a variable volume reservoir. The dashed lines in FIG. 10B illustrate the perimeter of the variable volume reservoir 100. The flexible layer 64 is not attached to the base 60 in the interior of the variable volume reservoir 100. The brackets labeled F in FIG. 10C and FIG. 10D indicate the locations where the flexible layer 64 is not attached to the base 60 and accordingly illustrate the location of the variable volume reservoir. The variable volume reservoirs illustrated in FIG. 10A through FIG. 10C are illustrated in the closed positioned and accordingly have a zero volume. FIG. 10D illustrates the volume control device 44 where the variable volume reservoir 100 is in an open position and contains a solution. Accordingly, the variable volume reservoir in FIG. 10D has a non-zero volume.

The volume control device 44 includes a reservoir opening in a transport channel 112. The volume control device 44 illustrated in FIG. 10A through FIG. 10D can be included in either of the volume control devices 44 illustrated in FIG. 2. Accordingly, the transport channel 112 can be the second common channel 32 of FIG. 2. The reservoir opening 83 serves as a conduit through which a solution in the transport channel 112 can enter the variable volume reservoir 100 from the transport channel 112 and/or enter the transport channel 112 from the variable volume reservoir 100. The volume of the variable volume reservoir 100 can be increased and/or decreased as is disclosed in the context of FIG. 9L and FIG. 9M.

Figure 10E:
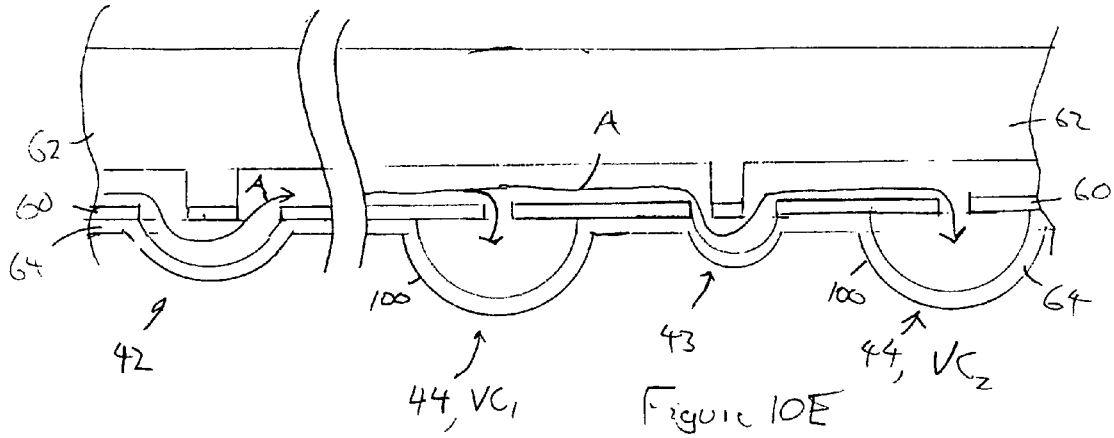
FIG. 10E through FIG. 10G illustrate operation of volume control devices so as to control the volume of a solution transported to different product chambers.
Figure 10F:
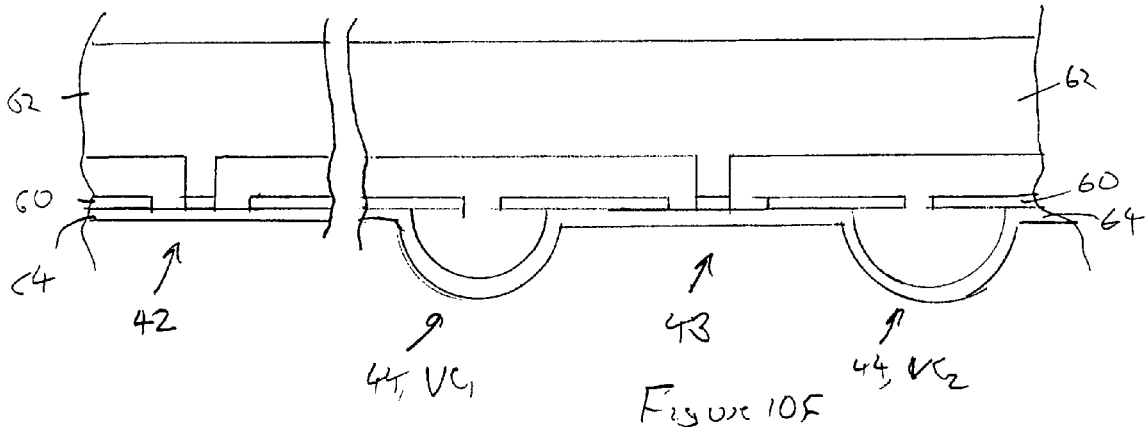
Figure 10G:
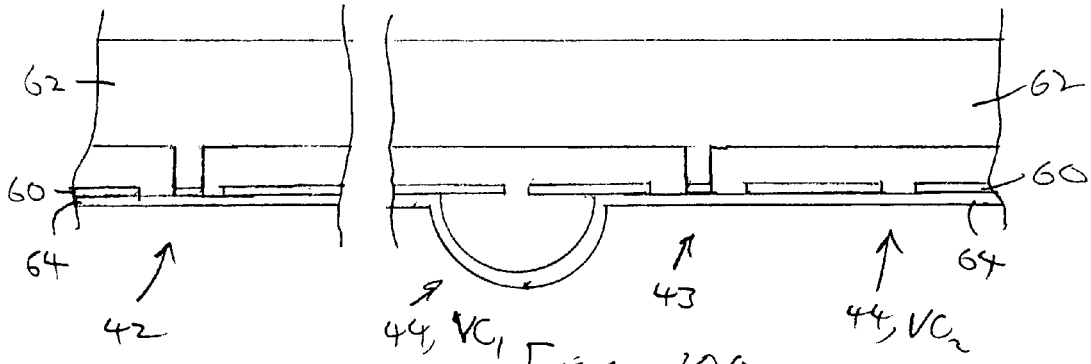

FIG. 10E through FIG. 10G illustrate operation of volume control devices so as to control the volume of a solution transported to different product chambers. The illustrated volume control devices are constructed according to FIG. 10A through FIG. 10D and are arranged as shown in FIG. 2. Accordingly, the isolation valve 43 of FIG. 2 is shown positioned between the volume control devices. Additionally, the outlet valve 42 of FIG. 2 is shown. The second valves 40 shown in FIG. 2 are also employed in the method but are not illustrated.

The outlet valve 42 and the isolation valve 43 are opened and a solution is transported into the variable volume reservoirs as illustrated by the arrow labeled A in FIG. 10E. During the transport of the solution into the variable volume reservoirs, the second valves (40 in FIG. 2) are closed to reduce or prevent flow of the solution into the independent channels (30 in FIG. 2) and/or product chambers (26 in FIG. 2).

The isolation valve 43 is closed as shown in FIG. 10F. Closing the isolation valve 43 closes the liquid communication between the volume control device 44 labeled $VC_1$ and the volume control device 44 labeled $VC_2$. The outlet valve 42 is also closed to prevent backflow of the solution from the volume control device toward the mixing component.

The second valves (40 in FIG. 2) are opened either together or one after another. Opening the second valves (40 in FIG. 2) opens the liquid communication between each of the product chambers (26 in FIG. 2) and the associated variable volume reservoir 100. As a result, closing the isolation valve 43 and the outlet valve 42 while opening the second valves closes the liquid communication between the volume control devices while opening liquid communication between each of the product chambers and the associated volume control device. Further, this arrangement also closes the liquid communication between each of the volume control devices and at least one of the product chambers. For instance, this arrangement stops the liquid communication between the volume control device 44 labeled $VC_1$ and the product chamber labeled $SC_2$ in FIG. 2.

Once the liquid communication is opened between a variable volume reservoir 100 and a product chamber, the volume of the variable volume reservoir 100 can be reduced as shown in FIG. 10G. Reducing the volume of the variable volume reservoir causes the solution to flow from the variable volume reservoir 100 into the product chamber. This can be repeated for each of the variable volume reservoirs until the solution is transported to each of the product chambers that are to receive the solution.

A variety of different mechanisms can be employed to control the amount of solution transported from a volume control device 44 and a product chamber. For instance, the volume of a volume control device 100 can be decreased an amount that is known to transport the desired amount of solution to the product chamber. Alternately, during and/or before the solution is transported into a variable volume reservoir, the variable volume reservoir can be opened to a volume that is known to transport the desired amount of solution to the product chamber when the variable volume reservoir is closed. As a result, closing the variable volume reservoir 100 after it receives the solution will transport the desired volume of the solution to the product chamber.

The volume of the solution that is transported to each of the product chambers can be the same or different. As a result, different variable volume reservoirs may be reduced different volumes in order to transport the solution to a product chamber. Additionally or alternately, different variable volume reservoirs can be opened to different volumes before or while the solution is being transported into the variable volume reservoir.

The function of the outlet valve 42 in the above method can be achieved with other valves in the transport component. For instance, the outlet valve prevents or reduces backflow of the solution. However, in some instances, this can be achieved with the inlet valve 41 and/or the first valves 38 shown in FIG. 2. Alternately, an additional isolation valve can be positioned along the second common channel 32 to provide this function. As a result, the use of the outlet valve in the above method is optional.

The above method can be adapted such that a solution is transported to only a portion of the product chambers or is transported to only one of the product chambers. As an example, if it is desirable to only transport a solution to the product chamber labeled $SC_2$, the above method can be performed without opening the variable chamber reservoir in the volume control device labeled $VC_1$. If it desirable to the product chamber labeled $SC_1$, the above method can be performed without opening the isolation valve 43. Additionally, the volume control function provided by the volume control devices can be bypassed by operating the volume control devices with each of the variable volume reservoirs in the closed position. As a result, a solution will not flow into the variable volume reservoirs and the volume control function will be bypassed.

The method described in the context of FIG. 10E through FIG. 10F is not limited to the transport structure illustrated in FIG. 2. For instance, the transport structure can include a plurality of volume control devices positioned along the second common channel 32 between independent channels 30. The transport component can also include additional isolation valves 43 positioned along the second common channel 32. The isolation valves and volume control devices can be arranged such that closing the isolation valve closes the liquid communication between different portions of the volume control devices while opening liquid communication between each of the product chambers and a different portion of the volume control devices.

Figure 11A:
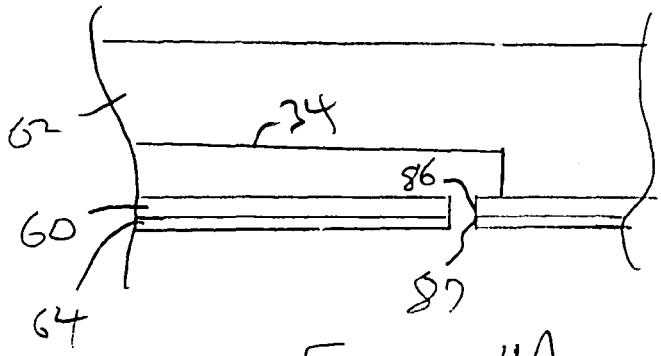
FIG. 11A illustrates a vent device that is formed upon assembly of the transport component shown in FIG. 5A and FIG. 5B.

FIG. 11A illustrates the vent device (35 FIG. 2) that is formed upon assembly of the transport component shown in FIG. 5A and FIG. 5B. FIG. 11A is a cross section of the transport component. The vent device includes a first vent opening 86 in the base 60 aligned with a second vent opening 87 in the flexible layer 62. The first vent opening 86 and the second vent opening 87 are aligned with the vent channel 34. As a result, air in the vent channel 34 can flow through the first vent opening 86 and the second vent opening 87 into the atmosphere or into a containment device.

Figure 11B:
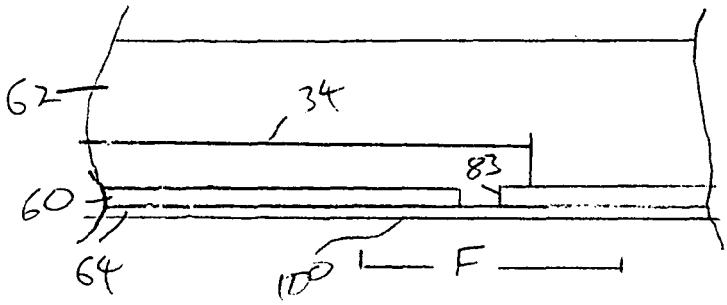
FIG. 11B and FIG. 11C illustrates a transport component having a vent device that includes a variable volume reservoir.
Figure 11C:
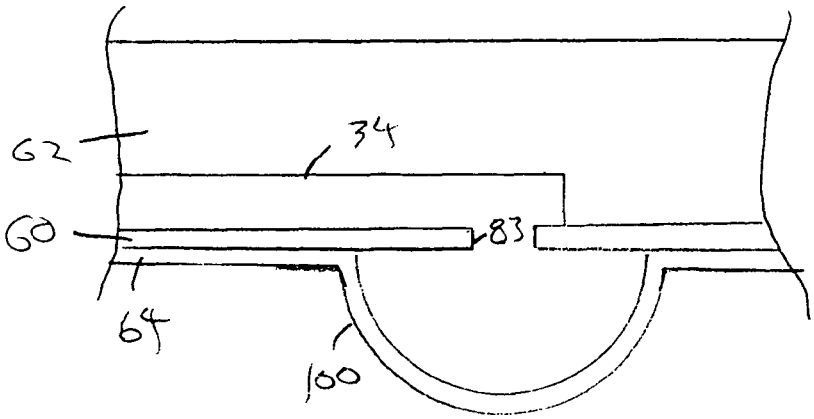

The transport component can include other vent device. FIG. 11B and FIG. 11C illustrates a transport component having a vent device that includes a variable volume reservoir. FIG. 11B is a cross section of the transport component. A reservoir opening 83 extends through base 60 and is positioned in the vent channel 34. Accordingly, the reservoir opening 83 serves as a conduit through which fluid can enter the variable volume reservoir 100 from the vent channel 34 and/or enter the vent channel 34 from the variable volume reservoir 100. As the pressure in the vent channel 34 increases, the fluid in the vent channel 34 enters the variable volume reservoir 100 and the volume of the variable volume reservoir increases as shown in FIG. 11C. As a result, the variable volume reservoir allows the fluid from the reservoir to be contained within the cartridge.

The variable volume reservoir in a venting device can be opened and closed using an external device the manifold as disclosed above. However, because the variable volume reservoir may open as a result of increasing pressure in the vent channel, external devices are optional.

Although the cartridge is shown having a single disruption mechanism associated with each reservoir, the cartridge can include more than one disruption mechanism associated with each reservoir and/or the base of the storage component can include more than one opening associated with each reservoir.

The transport component 13 illustrated above includes a base 60, a cover 62 and a flexible layer 64; however, the transport component can be constructed from more components or from fewer components. For instance, the cover 62 can be constructed from multiple layers. As an example of how the transport component can be constructed from additional components, the dashed lines in FIG. 5C divide the cover into two layers that could be bonded together to form the cover 62. In this embodiment, the channels would be formed by holes extending through the upper layer and the bottom layer could be a substrate that serves as the bottom or top of the channels. Further, the transport component can be constructed from fewer components by integrating the cover 62 and the base 60. Additionally, the base 60 is optional if part of the channel or chamber is defined by the flexible layer 64 in all or a portion of the transport component 13.

The maximum volume of the variable volume reservoirs disclosed above can be a function of the dimensions of the area over which the flexible layer 64 is not attached to the base 60, the flexibility of the flexible layer 64 and/or the volume of port 98 in manifold 96. The variable volume reservoirs disclosed above can each have the same maximum volume or can have different maximum volumes. For instance, a variable volume reservoir in a mixing component can have a different maximum volume that a variable volume reservoir in a volume control device. The maximum volume of a variable volume reservoir in the mixing component is preferably greater than 2 μL, 20 μL or 2 ml. The maximum volume of a variable volume reservoir in at least one of the volume control reservoirs is preferably greater than 1 μL, 10 μL or 1 ml. The maximum volume of a variable volume reservoir in a vent device is preferably greater than 1 μL, 10 μL or 1 mL.

The maximum volume of the variable volume reservoirs in the mixing component and/or in a volume control device is preferably greater than the maximum volume resulting from the volume variation that occurs upon operation of the above valves. This volume relationship is desirable because the variable volume reservoirs provide temporary solution storage functions where the valves are extensions of the transports channels. The maximum volume of the variable volume reservoirs in the mixing component and/or in a volume control device is preferably greater than 1 time, 10 times, or 100 times the maximum volume provided by the volume variation that occurs upon operation of the above valves.

The layout and structure of the transport component described above is provided as an example and other layouts and the principles of the invention can be applied to cartridge with other layouts and structures. For instance, a cartridge with a different layout is set forth in U.S. Provisional Patent Application Ser. No. 60/528,566, filed on Dec. 9, 2003 entitled "Cartridge for Use With Electrochemical Sensors;" and also in U.S. patent application Ser. No. 10/941,517, filed on Sep. 14, 2004, entitled "Cartridge for Use With Electrochemical Sensors;" each of which are incorporated herein in its entirety.

Although portions of the invention are disclosed in the context of a solution being transported from a mixing component into a product chamber, in some instances, the cartridge does not include a product chamber after the mixing component. Accordingly, the solutions can be mixed and then transported out of the cartridge without being transported into a product chamber.

The invention claimed is:

1. A cartridge, comprising:

layers of material stacked together such that each layer contacts at least one other layer, and a portion of each layer being immobilized relative to a portion of each one of the other layers, the layers including a base between a cover and a flexible layer;

a mixing component defined by the layers, the mixing component including a plurality of variable volume reservoirs in liquid communication with one another and being configured to mix different solutions so as to generate a product solution, the mixing component including openings extending through the base, a side of the base having bonded regions where the side of the base is bonded to the flexible layer and unbonded regions where the side of the base is not bonded to the flexible layer, each of the openings in the base being surround by an unbonded region and each of the unbonded regions that surrounds an opening being surrounded by a bonded region, each variable volume reservoir being defined by a different one of the unbonded regions of the base and the flexible layer and having a volume that increases as a result of movement of the flexible layer away from the unbonded region of the base, and the cover defining a mixing channel that is open to the openings in the base such that the mixing channel can transport a liquid from one of the openings in the base to another of the openings in the base;

one or more chambers in the cartridge, the one or more chambers being defined by the layers; and one or more channels that provide liquid communication between the mixing component and the one or more chambers, the one or more channels being defined by the layers.

2. The cartridge of claim 1, wherein the cross-sectional area of the mixing channel is greater than the cross-sectional area of one or more channels configured to carry liquid away from the mixing component.

3. The cartridge of claim 1, further comprising:

one or more inlet channels configured to provide liquid communication between the mixing component and one or more storage reservoirs.

4. The cartridge of claim 3, wherein one or more of the inlet channels is in liquid communication with a vent channel configured to vent gasses from the inlet channel, the vent channel being configured to transport the gasses to and/or from a variable volume reservoir.

5. The cartridge of claim 3, wherein one or more valves are positioned along one or more of the inlet channels such that closing of the one or more valves hydraulically isolates the mixing component from the one or more storage reservoirs.

6. The cartridge of claim 3, wherein:

the cartridge includes a storage component that includes at least a portion of the storage reservoirs; and the cartridge includes a transport component configured to be coupled with the storage component, the transport component being configured to transport the solutions from one or more of the reservoirs to the one or more chambers, the transport component being removably attachable to the storage component.

7. The cartridge of claim 6, wherein no more than two channels are in direct liquid communication with the mixing component.

8. The cartridge of claim 1, wherein one or more variable volume reservoirs are positioned along a channel between the mixing component and one or more of the chambers.

9. The cartridge of claim 1, wherein a plurality of the chambers are in liquid communication with the mixing component, each of the chambers being in liquid communication with a different variable volume reservoir.

10. The cartridge of claim 1, wherein the one or more chambers are fixed volume chambers and one or more sensors are positioned in each of the chambers, each chamber is in liquid communication with a different variable volume reservoir, and one or more valves are positioned in the channels such that closing of the one or more valves hydraulically isolates the chambers from the mixing component.

11. The cartridge of claim 1, wherein each of the chambers includes one or more electrochemical sensors for the detecting the presence and/or amount of an agent in a liquid.

12. The cartridge of claim 1, wherein the layers are stacked together so as to form a substantially block-shaped structure.

13. The cartridge of claim 1, wherein each of the layers is substantially card-shaped.

14. The cartridge of claim 13, wherein the layers are stacked together so as to form a substantially card-shaped structure.

15. The cartridge of claim 1, wherein each of the layers is substantially planar.

16. The cartridge of claim 15, wherein the layers are stacked together so as to form a substantially card-shaped structure.

17. The cartridge of claim 1, wherein one or more sensors are positioned in each of the one or more chambers.

18. The cartridge of claim 17, wherein each chamber is in liquid communication with a different variable volume reservoir, and one or more valves are positioned in the channels such that closing of the one or more valves hydraulically isolates the chambers from the mixing component.

19. The cartridge of claim 18, wherein each of the sensors is a sensor for detecting the presence and/or amount of an agent in a liquid.

20. The cartridge of claim 19, wherein each of the sensors is an electrochemical sensor.

21. The cartridge of claim 20, further comprising:

one or more inlet channels defined by the layers, the one or more inlet channels configured to provide liquid communication between the mixing component and one or more storage reservoirs;

the one or more of the inlet channels being in liquid communication with a vent channel defined by the layers, the vent channel being configured to vent gasses from the inlet channel and to transport the gasses to a variable volume reservoir; and one or more valves defined by the layers, the valves being positioned along one or more of the inlet channels such that closing of the one or more valves hydraulically isolates the mixing component from the one or more storage reservoirs.

22. The cartridge of claim 1, wherein the unbonded region of the base contacts the flexible region before the movement of the flexible layer away from the unbonded region of the base.

23. A cartridge, comprising:

layers of material stacked together such that each layer contacts at least one other layer, and a portion of each layer being immobilized relative to a portion of each one of the other layers, the layers including a base between a cover and a flexible layer;

a plurality of chambers within the cartridge, the chambers being defined by the layers;

one or more variable volume reservoirs having a maximum volume greater than 1 μL, the one or more variable volume reservoirs being defined by the layers, each of the variable volume reservoirs being associated with a different opening extending through the base, a side of the base having bonded regions where the base is bonded to the flexible layer, each of the variable volume reservoirs being associated with an unbonded region of the base, each unbonded region of the base being a region of the base where the side is not bonded to the flexible layer, each of the openings in the base being surround by one of the unbonded regions and each of the unbonded regions that surrounds an opening being surrounded by one of the bonded regions, each of the variable volume reservoirs being defined by a different one of the unbonded regions of the base and the flexible layer and having a volume that increases as a result of movement of the flexible layer away from the unbonded region of the base; and a plurality of transport channels providing liquid communication between the one or more variable volume reservoirs and the chambers, the transport channels being defined by the layers.

24. A cartridge comprising:

layers of material stacked together such that each layer contacts at least one other layer, and a portion of each layer being immobilized relative to a portion of each one of the other layers, the layers including a base between a cover and a flexible layer;

a vent channel interfaced with a transport channel such that the vent channel removes gasses from the transport channel when a solution is transported through the transport channel, the vent channel and the transport channel each being defined by the layers; and a variable volume reservoir defined by the layers, the variable volume reservoir being in fluid communication with the vent channel such that the volume of the variable volume reservoir increase upon the pressure in the vent channel increasing the variable volume reservoir being associated with an opening extending through the base, a side of the base having a bonded region where the base is bonded to the flexible layer and an unbonded region where the side is not bonded to the flexible layer, the opening in the base being surround by the unbonded region and the unbonded region being surrounded by the bonded region, the variable volume reservoirs being defined by the unbonded region of the base and the flexible layer and the volume of the variable volume reservoir increasing as a result of movement of the flexible layer away from the unbonded region of the base.

* * * * *